US008726573B2

(12) United States Patent
Katayama et al.

(10) Patent No.: US 8,726,573 B2
(45) Date of Patent: May 20, 2014

(54) WINDOW REGULATOR DEVICE

(75) Inventors: Hidefumi Katayama, Anjo (JP); Ryoichi Fukumoto, Nagoya (JP); Ryujiro Akizuki, Kariya (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 0 days.

(21) Appl. No.: 13/497,672

(22) PCT Filed: Sep. 15, 2010

(86) PCT No.: PCT/JP2010/065970
§ 371 (c)(1),
(2), (4) Date: Mar. 22, 2012

(87) PCT Pub. No.: WO2011/040245
PCT Pub. Date: Apr. 7, 2011

(65) Prior Publication Data

US 2012/0192491 A1 Aug. 2, 2012

(30) Foreign Application Priority Data

Sep. 29, 2009 (JP) ..... 2009-224346

(51) Int. Cl.
*E05F 11/44* (2006.01)

(52) U.S. Cl.
USPC ..... 49/351; 49/349; 49/26; 49/28

(58) Field of Classification Search
USPC ..... 49/348, 349, 351, 26, 27, 28
See application file for complete search history.

(56) References Cited

U.S. PATENT DOCUMENTS

| | | | | |
|---|---|---|---|---|
| 5,749,173 | A * | 5/1998 | Ishida et al. | 49/349 |
| 6,114,820 | A * | 9/2000 | Nishigaya | 318/466 |
| 2005/0072049 | A1 * | 4/2005 | Spaziani et al. | 49/349 |
| 2012/0198770 | A1 * | 8/2012 | Katayama et al. | 49/28 |

FOREIGN PATENT DOCUMENTS

| | | | |
|---|---|---|---|
| CN | 1187568 | A | 7/1998 |
| JP | 11-101058 | | 4/1999 |
| JP | 2000-227304 | A | 8/2000 |
| JP | 3217048 | | 10/2001 |
| JP | 3713792 | | 11/2005 |

OTHER PUBLICATIONS

Combined Office Action and Search Report issued on Dec. 5, 2012, in Chinese Patent Application No. 201080043356.3 with English translation.

International Search Report issued Dec. 21, 2010, in PCT/JP2010/065970, filed Sep. 15, 2010.

* cited by examiner

*Primary Examiner* — Gregory J. Strimbu

(74) *Attorney, Agent, or Firm* — Oblon, Spivak, McClelland, Maier & Neustadt, L.L.P.

(57) ABSTRACT

A position detection unit includes a rotational member rotatable by a rotational drive force of an output shaft, an operation lever configured to avoid engaging with the rotational member when an a position of a window glass is situated out of an insensitive area, and engage with the rotational member when the position of the window glass is situated within the insensitive area, the operation lever being rotated by the rotational drive force of the output shaft transmitted via the rotational member when the operation lever engages with the rotational member, and an insensitive area detection switch for performing a switching operation based on a rotational operation of the operation lever.

6 Claims, 22 Drawing Sheets

WINDOW REGULATOR DEVICE

TECHNICAL FIELD

The present invention relates to a window regulator device for automatically opening and closing a window glass of a vehicle by a force that is generated by a power source such as an electric motor. In particular, the present invention relates to a window regulator device including open/close position detection means for detecting whether or not an open/close position of a window glass is situated within a specific positional area that is set in advance.

BACKGROUND ART

Conventionally, window glasses mounted onto a side window, a roof window, and the like of a vehicle are manually opened and closed, but currently, most window glasses of a vehicle are automatically opened and closed by a force that is generated by a power source such as an electric motor. When the window glass is automatically closed, a foreign object may be pinched between the window glass and the window frame. There has already been developed a window regulator device having an anti-pinch function, in which when the pinching of the foreign object is detected, an operation of the window glass in a closing direction (closing operation) is stopped, or an operation direction of the window glass is reversed, to thereby eliminate the pinching.

The pinching of the foreign object is generally detected in response to increase in load applied from the window glass side to the power source side, or decrease in operation speed of the window glass. However, the pinching of the foreign object is erroneously detected in some cases. For example, when the window glass provided to the side window of the vehicle is closed so that an open/close position thereof is shifted to the vicinity of a fully closed position, an upper side edge of the window glass may be brought into contact with an inner bottom wall of a weatherstrip provided to the window frame, and the weatherstrip may be pinched between the window frame and the window glass. When the load increases or the operation speed of the window glass decreases due to the pinching of the weatherstrip, the pinching is erroneously detected even though the foreign object is not pinched.

When the pinching is erroneously detected and anti-pinch processing is executed based on the erroneous detection, the operation of the window glass to be closed is suddenly stopped or reversed, with the result that a passenger of the vehicle may feel inconvenience. In order to prevent such an erroneous operation of the window glass caused by the erroneous detection of the pinching, conventionally, an open/close area of the window glass in which the erroneous detection of the pinching frequently occurs (for example, an area of the window glass ranging from a position in the vicinity of the fully closed position to the fully closed position, in which the weatherstrip may be pinched as described above) is set as an insensitive area, and in a case where the open/close position of the window glass is situated within the insensitive area, even when the pinching is detected, the operation based on the detection is inhibited.

In this case, it is necessary to detect whether or not the open/close position of the window glass is situated within the insensitive area. Japanese Patent Application Laid-open No. Hei 11-101058 discloses a window regulator device (motor-driven window opening/closing device) including a cam member formed on an inner periphery side of a pinion gear, which is coupled to an output shaft of an electric motor via a clutch mechanism, and a switch including a contact element arranged so as to be brought into contact with the cam member, the window regulator device being configured to open and close the window glass by a rotational drive force of the output shaft. According to this window regulator device, based on a contact state between the cam member and the contact element, it is detected whether or not the open/close position of the window glass is situated within the insensitive area.

CITATION LIST

Patent Literature

[PTL 1] Japanese Patent Application Laid-open No. Hei 11-101058

SUMMARY OF INVENTION

Technical Problems

According to the window regulator device described in Japanese Patent Application Laid-open No. Hei 11-101058, the cam member for detecting whether or not the open/close position of the window glass is situated within the insensitive area is formed on the inner periphery side of the rotational member (pinion gear) coupled to the output shaft. As can be seen from FIG. 2 or FIG. 4 of Japanese Patent Application Laid-open No. Hei 11-101058, the pinion gear is arranged in a housing so as to be adjacent to a drive gear, and hence the space is greatly limited. Therefore, the pinion gear is a small member. Further, the cam formed on the inner periphery side of the pinion gear is also a small member. In a case where such a small cam member is used for detecting whether or not the open/close position of the window glass is situated within the insensitive area, detection accuracy may greatly deteriorate due to a slight assembly error. Further, in a case where the shape of the cam member and the mounting angle of the pinion gear are strictly managed in order to prevent deterioration in detection accuracy, manufacturing cost and assembly cost increase.

The present invention has been made to solve the above-mentioned problems, and it is therefore an object of the present invention to provide a window regulator device including open/close position detection means for detecting whether or not an open/close position of a window glass is situated within a specific positional area such as an insensitive area, the window regulator device being capable of suppressing deterioration in detection accuracy of the open/close position to be detected by the open/close position detection means.

Solution to Problems

The present invention discloses a window regulator device, including: a power source; an output shaft connected to the power source and rotatable by a force that is generated by the power source; a drive force transmission mechanism for transmitting a rotational drive force of the output shaft to a window glass of a vehicle so as to open and close the window glass by the rotational drive force of the output shaft; and open/close position detection means for detecting whether or not an open/close position of the window glass is situated within a specific positional area that is an open/close position area set in advance. The open/close position detection means includes: a rotational member rotatable by the rotational drive force of the output shaft; an operation lever configured to avoid engaging with the rotational member when the open/ close position of the window glass is situated out of the specific positional area, and engage with the rotational member when the open/close position of the window glass is situated within the specific positional area, the operation lever being rotated by the rotational drive force of the output shaft transmitted via the rotational member when the operation lever engages with the rotational member; and a specific positional area detection switch for performing a switching operation based on a rotational operation of the operation lever.

According to the present invention, the rotation of the output shaft rotatable by the force of the power source is transmitted to the window glass via the drive force transmission mechanism. Accordingly, the window glass is opened and closed along with the rotation of the output shaft. Further, the rotational member rotates by the rotational drive force of the output shaft. The rotational member engages with the operation lever when the open/close position of the window glass is situated within the specific positional area that is set in advance. When the operation lever and the rotational member engage with each other, the operation lever is rotated by the rotational drive force of the output shaft transmitted via the rotational member. Based on such a rotational operation of the operation lever, the specific positional area detection switch performs the switching operation. Thus, based on the switching state of the specific positional area detection switch, it is detected whether or not the open/close position of the window glass is situated within the specific positional area.

As described above, the operation lever is used as a detection member for detecting whether or not the open/close position of the window glass is situated within the specific positional area. The operation lever is a member provided separately from the rotational member, and hence an operation stroke thereof can be increased irrespective of the size of the rotational member. The operation stroke can be increased, and hence, even when a certain amount of displacement has occurred in the arrangement of the operation lever and the specific positional area detection switch, a detection error of the specific positional area based on the displacement can be reduced. Thus, even when the assembly accuracy is not strictly managed, the deterioration in detection accuracy can be suppressed sufficiently.

In the present invention, the electric motor may generally be employed as the "power source", but any power source may be employed as long as the power source can apply rotational torque to the output shaft. Further, the "specific positional area" is preferred to be the above-mentioned insensitive area, but is not limited thereto. The specific positional area may be such an area that the stop or reverse of the closing operation of the window glass is to be avoided even when the pinching is detected, or an area that is arbitrarily set based on a desired request. Further, as the "specific positional area detection switch", any type of switch may be employed as long as the switch performs the switching operation based on the rotational operation of the operation lever. For example, as the specific positional area detection switch, there may be employed a contact point switch including a substrate, a conductive portion formed on the substrate, and a movable piece having a base end coupled to a part of the conductive portion and having a tip end spaced apart from the substrate. In a case where such a switch is employed, the switch may be arranged relative to the operation lever so that, for example, when the operation lever is not rotated, the tip end of the movable piece is brought into contact with the conductive portion (or the tip end of the movable piece is spaced apart from the conductive portion) to set the switching state of the switch to the ON state (or OFF state), and when the operation lever is rotated, the tip end of the movable piece is spaced apart from the conductive portion (or the tip end of the movable piece is brought into contact with the conductive portion) to set the switching state of the switch to the OFF state (or ON state).

Further, the window regulator device of the present invention may include, for example, an ECU for outputting an instruction signal for executing anti-pinch processing based on the switching state of the specific positional area detection switch, but may omit such an ECU. In a case where the window regulator device includes such an ECU, the anti-pinch processing is executed based on the instruction signal output from the ECU. On the other hand, even in a case where the window regulator device does not include such an ECU, the specific positional area detection switch itself is integrated into a drive circuit for driving the power source such as an electric motor, and the energized/non-energized state of the power source is switched or the direction of energization of the power source is switched in accordance with the switching state of the switch. With the above-mentioned structure, the anti-pinch processing can be executed. Accordingly, the anti-pinch processing can be executed without using the ECU, and hence the window regulator device having the anti-pinch function can be manufactured at lower cost.

Further, it is preferred that the rotational member include: a first gear supported by the output shaft so as to be rotatable integrally therewith; and a second gear meshing with the first gear and configured to reduce rotation of the first gear, the second gear including an engagement member mounted so as to be engageable with the operation lever. Further, it is preferred that the engagement member be arranged on the second gear so as to avoid engaging with the operation lever when the open/close position of the window glass is situated out of the specific positional area, and engage with the operation lever when the open/close position of the window glass is situated within the specific positional area. Still further, it is preferred that the operation lever be rotated by the rotational drive force of the output shaft transmitted via the second gear when the operation lever engages with the engagement member.

Accordingly, the first gear rotates along with the rotation of the output shaft. Then, the second gear meshing with the first gear performs reduced rotation in a direction opposite to the rotational direction of the first gear. Through the rotation of the second gear, the engagement member mounted onto the second gear also rotates. When the open/close position of the window glass is situated within the specific positional area, the engagement member engages with the operation lever. At the time of the engagement, the operation lever is rotated by the rotational drive force of the output shaft. Based on such a rotational operation of the operation lever, the specific positional area detection switch performs the switching operation. With this structure, at the time of the engagement between the engagement member and the operation lever, the rotational drive force of the output shaft can reliably be transmitted to the operation lever.

The "engagement member" may be formed integrally with the second gear, or may be formed separately from the second gear and then mounted onto the second gear. Considering the manufacturing cost, it is preferred that the engagement member be formed integrally with the second gear and serve as a part of the second gear. Further, The engagement member may be provided to a surface portion of the second gear.

Further, it is preferred that the operation lever be supported by the output shaft so as to be relatively rotatable, and be coupled to the second gear via a coupling pin. That is, it is preferred that the operation lever be supported by the output shaft so as to be relatively rotatable, and rotatably support the second gear via the coupling pin. More specifically, it is preferred that the operation lever be supported by the output shaft so as to be relatively rotatable, and be coupled via the coupling pin to the second gear, which is supported by the coupling pin so as to be relatively rotatable.

When the engagement member formed on the second gear engages with the operation lever, through the engagement, the rotation of the second gear relative to the operation lever is stopped. When the rotation of the second gear is stopped, the second gear revolves about the first gear in the same direction as the rotational direction of the first gear due to the mesh with the first gear. Along with the revolution, the operation lever coupled to the second gear via the coupling pin is rotated about the output shaft (first gear) in the same direction as the rotational direction of the first gear. That is, the rotation of the second gear relative to the operation lever is stopped when the engagement member formed on the second gear engages with the operation lever, and the second gear and the operation lever are integrally rotated through the coupling via the coupling pin while receiving the drive force of the first gear. As described above, along with the revolution of the second gear, the operation lever is rotated reliably.

Further, it is preferred that the open/close position detection means further include: a biasing member for biasing the operation lever in one rotational direction; and an alignment member for regulating rotation of the operation lever that is caused by a biasing force of the biasing member to align a rotational position of the operation lever. Accordingly, through the biasing of the operation lever performed by the biasing member and the regulation of rotation of the operation lever performed by the alignment member, the operation lever is aligned at a desired position.

Further, it is preferred that the operation lever include a tooth portion formed therein, and the rotational member includes: a first gear supported by the output shaft so as to be rotatable integrally therewith; a second gear supported by a support pin so as to be meshable with the first gear and configured to reduce rotation of the first gear; and a third gear supported by the support pin so as to be rotatable integrally with the second gear and including a tooth portion formed at a part of an outer periphery thereof, the tooth portion being meshable with the tooth portion of the operation lever. Further, it is preferred that the tooth portion formed in the third gear be formed at such a position as to avoid meshing with the tooth portion formed in the operation lever when the open/close position of the window glass is situated out of the specific positional area, and mesh with the tooth portion formed in the operation lever when the open/close position of the window glass is situated within the specific positional area. Still further, it is preferred that the operation lever be rotated by the rotational drive force of the output shaft transmitted via the third gear when the tooth portion of the operation lever meshes with the tooth portion formed in the third gear. In this case, it is preferred that the open/close position detection means further include an elastic member for elastically aligning a rotational position of the operation lever, and the operation lever be rotated by the rotational drive force of the output shaft against an elastic force that is generated by the elastic member when the operation lever meshes with the third gear.

Accordingly, the first gear rotates along with the rotation of the output shaft. Then, the second gear meshing with the first gear performs reduced rotation. Further, the third gear supported by the support pin so as to be rotatable integrally with the second gear also rotates. Through the rotation of the third gear, the tooth portion formed in the third gear also rotates. When the open/close position of the window glass is situated within the specific positional area, the tooth portion formed in the third gear meshes with the tooth portion formed in the operation lever. Through the mesh, the third gear and the operation lever engage with each other, and the rotational drive force of the output shaft is transmitted to the operation lever. Accordingly, the operation lever is rotated against the elastic force that is generated by the elastic member, which aligns the operation lever. Based on the rotational operation of the operation lever, the specific positional area detection switch performs the switching operation. As described above, the open/close position detection means is configured so that the operation lever is rotated through the mesh with the third gear, and accordingly the operation lever is rotated reliably.

DESCRIPTION OF EMBODIMENTS (First Embodiment)

Figure 1:
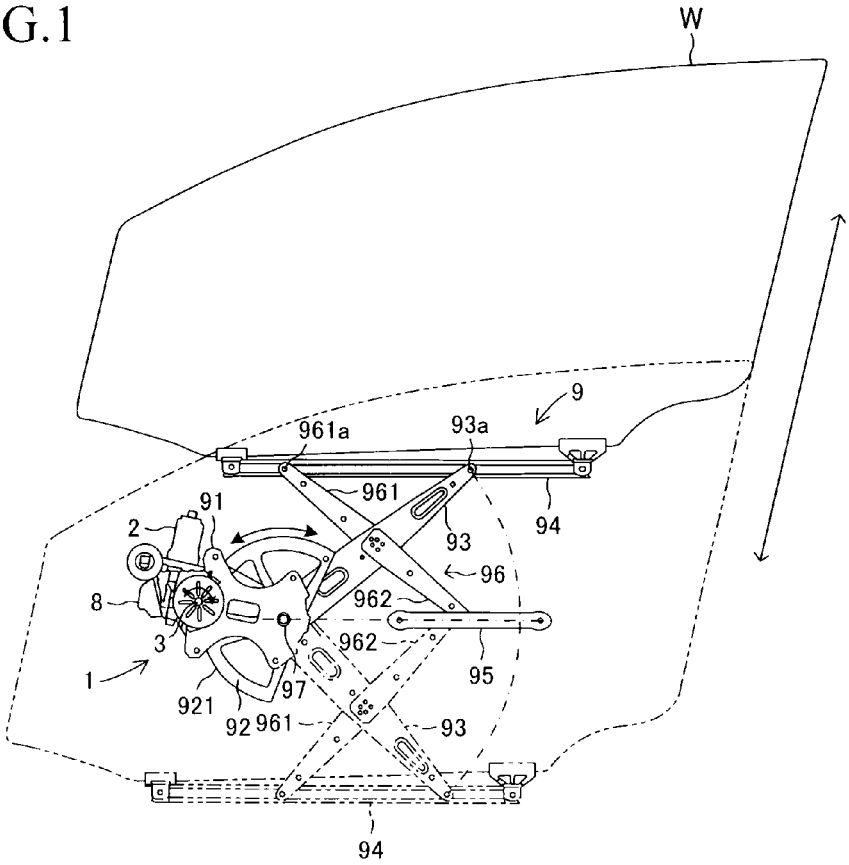
FIG. 1 is a front view illustrating an overall structure of a window regulator device.

Hereinafter, a first embodiment of the present invention is described. FIG. 1 is a front view illustrating an overall structure of a window regulator device according to this embodiment. The window regulator device opens and closes a window glass provided to a side window of a vehicle. As illustrated in FIG. 1, the window regulator device includes a drive mechanism 1 and a drive force transmission mechanism 9. The drive mechanism 1 includes an electric motor 2 serving as a power source for opening and closing the window glass, an output shaft 3, a housing 8 coupled to the electric motor 2, and a detection unit (not shown) housed in the housing 8. The electric motor 2 is, for example, electrically connected to an electric power source such as an on-vehicle battery, and an electric power is supplied thereto from the electric power source so that a rotational drive force is generated. The output shaft 3 is rotated by the rotational drive force that is generated by the electric motor 2. The drive force transmission mechanism 9 transmits the rotational drive force of the output shaft 3 to a window glass W so as to open and close the window glass W by the rotational drive force of the output shaft 3 in upward and downward directions indicated by the arrows of FIG. 1. The detection unit housed in the housing 8 detects whether or not a foreign object is pinched between the window glass W and a window frame during a closing operation of the window glass W, and whether or not an open/close position of the window glass W is situated within a specific open/close position area (specific positional area) that is set in advance.

As illustrated in FIG. 1, the drive force transmission mechanism 9 includes a fixed bracket 91, a sector gear 92, a lift arm 93, a first guide rail member 94, a second guide rail member 95, and an equalizer arm 96. The fixed bracket 91 is fixed to a door panel of the vehicle and supports the housing 8. As illustrated in FIG. 1, the sector gear 92 includes an arc-like tooth portion 921 and is coupled to the fixed bracket 91 at the center of the arc of the tooth portion 921 so as to be rotatable about a pin 97.

The lift arm 93 is an elongated member and is formed into a tapered shape toward a tip end thereof. The lift arm 93 is fixed to a rotational center position of the sector gear 92 on a base end side thereof. Thus, when the sector gear 92 rotates about the pin 97, the lift arm 93 also rotates in the same direction about the pin 97. Further, a shoe 93*a* is coupled to the tip end of the lift arm 93.

The first guide rail member 94 is fixed substantially horizontally to a lower portion of the window glass W. A guide groove is formed in the first guide rail member 94 along a longitudinal direction thereof. The shoe 93*a* is slidably disposed in the guide groove. The second guide rail member 95 is fixed to the door panel. A guide groove is also formed in the second guide rail member 95 along a longitudinal direction thereof.

The equalizer arm 96 includes a first arm 961 and a second arm 962. Each of the first arm 961 and the second arm 962 is an elongated member. Both the arms are joined at base end sides thereof in the vicinity of a substantial center of the lift arm 93. The first arm 961 and the second arm 962 are linearly fixed so as to have the same axis in front view under the state in which both the arms are joined, and are rotatably coupled to the lift arm 93 in the vicinity of the center of the lift arm 93. Further, a shoe 961*a* is coupled to a tip end of the first arm 961. The shoe 961*a* is slidably disposed in the guide groove of the first guide rail member 94. A shoe is also coupled to a tip end of the second arm 962, and the shoe is slidably disposed in the guide groove of the second guide rail member 95. Thus, the tip end of the lift arm 93 and the tip end of the first arm 961 are coupled to the guide groove of the first guide rail member 94 via the shoes, and the tip end of the second arm 962 is coupled to the guide groove of the second guide rail member 95 via the shoe. Further, dimensions of the arms are adjusted so that the first guide rail member 94 and the second guide rail member 95 are arranged in parallel to each other.

The output shaft 3 is rotatably supported by the housing 8. The output shaft 3 is rotated by the rotational drive force of the electric motor 2. As described later, an output gear portion is formed in the output shaft 3, and the output gear portion meshes with the tooth portion 921 of the sector gear 92.

In this structure, when the output shaft 3 rotates clockwise in FIG. 1, the rotation is transmitted to the sector gear 92, and the sector gear 92 rotates counterclockwise about the pin 97. Along with the rotation of the sector gear 92, the lift arm 93 also rotates counterclockwise about the pin 97. When the lift arm 93 rotates counterclockwise, the shoe 93*a* mounted onto the tip end of the lift arm 93 draws an arc-like locus as indicated by the chain line of FIG. 1. Therefore, the shoe 93*a* slides in the guide groove of the first guide rail member 94 and the first guide rail member 94 moves upward. Along with the upward movement of the first guide rail member 94, the window glass W moves upward so that the window glass W is closed. At the time of the closing operation of the window glass W, the equalizer arm 96 rotates so as to maintain the structural arrangement relationship among the lift arm 93, the first guide rail member 94, and the second guide rail member 95. Thus, at the time of the closing operation of the window glass W, the first guide rail member 94 is raised while maintaining the parallel state with the second guide rail member 95.

Meanwhile, when the output shaft 3 rotates counterclockwise in FIG. 1, the sector gear 92 rotates clockwise about the pin 97. Along with the rotation of the sector gear 92, the lift arm 93 also rotates clockwise about the pin 97. Accordingly, the shoe 93*a* slides in the guide groove of the first guide rail member 94 and the first guide rail member 94 moves downward. Through the downward movement of the first guide rail member 94, the window glass W also moves downward so that the window glass W is operated in an opening direction (opened). At the time of the opening operation of the window glass W, the equalizer arm 96 rotates so as to maintain the structural arrangement relationship among the lift arm 93, the first guide rail member 94, and the second guide rail member 95. Thus, at the time of the opening operation of the window glass, the first guide rail member 94 is lowered while maintaining the parallel state with the second guide rail member 95. In this manner, the window glass W is opened and closed. Note that, the open/close position of the window glass W indicated by the solid line of FIG. 1 is a fully closed position, and the open/close position of the window glass W indicated by the two-dot chain line of FIG. 1 is a fully opened position.

Figure 2:
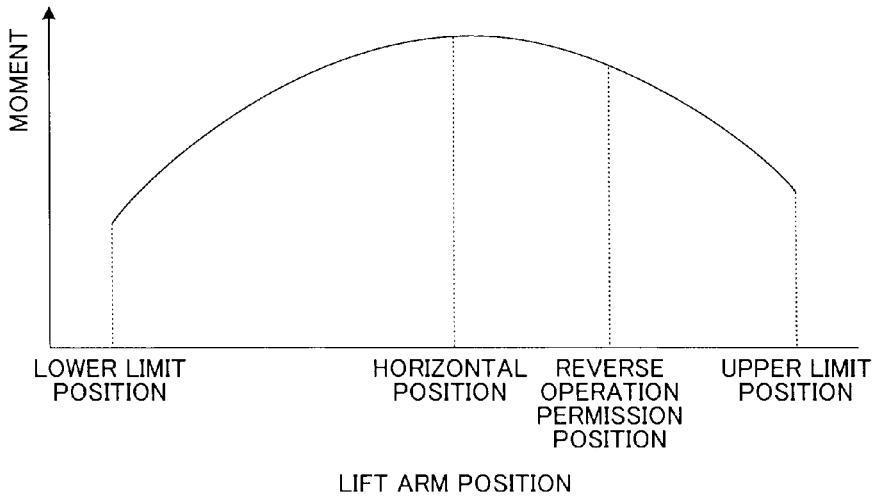
FIG. 2 is a graph showing a relationship between a magnitude of moment, which acts on an output shaft 3 when a window glass is closed from a fully opened position to a fully closed position, and a rotational position of a lift arm.

In the window regulator device including the arm-type drive force transmission mechanism 9 that is operated as described above, rotational motion of the lift arm 93 is converted into linear motion of the window glass W. Thus, at the time of the closing operation of the window glass W, the moment acting on the output shaft 3 due to the load of the window glass W changes depending on a rotational position of the lift arm 93. FIG. 2 is a graph showing a relationship between the magnitude of the moment, which acts on the output shaft 3 when the window glass W is closed from the fully opened position (lower limit position) to the fully closed position (upper limit position), and the rotational position of the lift arm 93. As can be seen from the graph, the moment exhibits the maximum value when the rotational position of the lift arm 93 is a horizontal position orthogonal to the direction of gravity. The moment becomes smaller as the rotational position of the lift arm 93 shifts from the horizontal position toward the upper limit position (fully closed position of the window glass W) or the lower limit position (fully opened position of the window glass).

Figure 3:
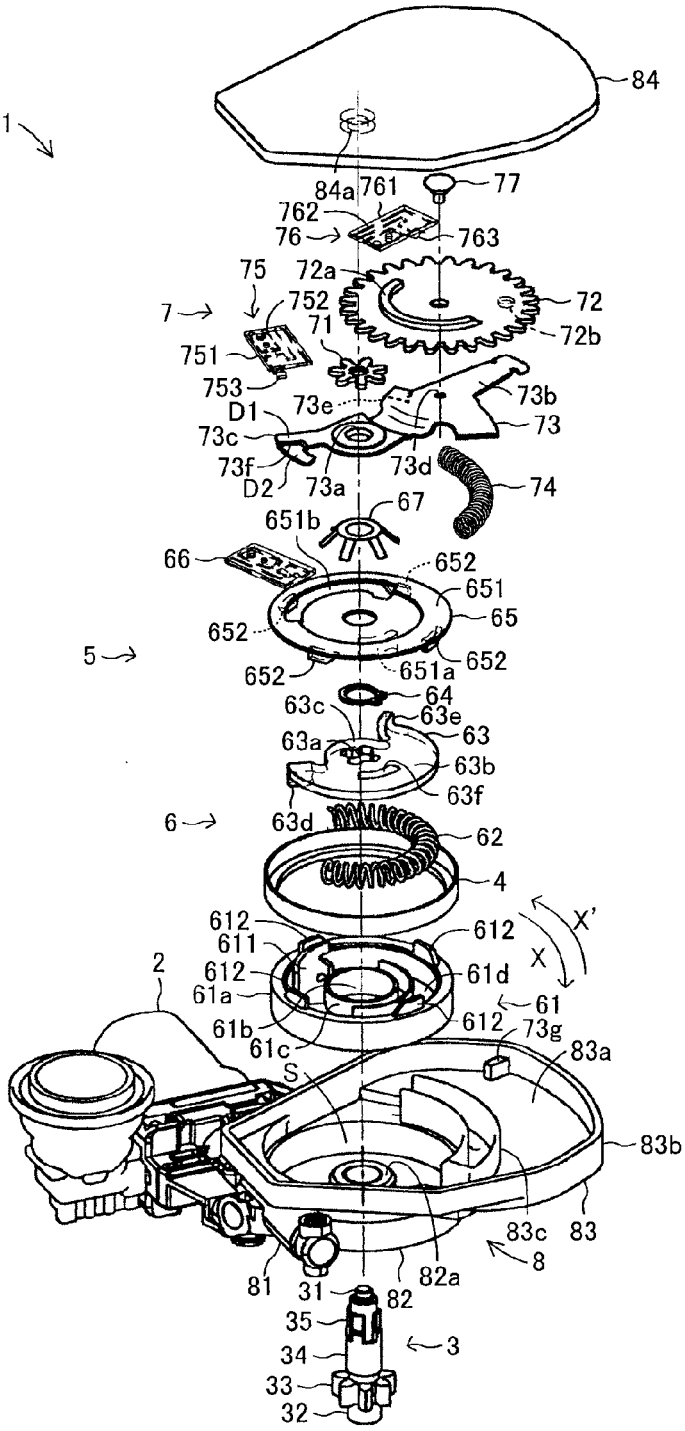
FIG. 3 is an exploded perspective view of a drive mechanism according to a first embodiment of the present invention.

FIG. 3 is an exploded perspective view of the drive mechanism 1. As illustrated in FIG. 3, the drive mechanism 1 includes the electric motor 2, the output shaft 3, a detection unit 5, and the housing 8. The electric motor 2 is coupled to the housing 8 by fastening means (not shown) or the like. The housing 8 includes a first housing portion 81, a second housing portion 82, a third housing portion 83, and a lid 84. The first housing portion 81 is formed into a cylindrical shape elongated in an axial direction of the electric motor 2, and a worm (not shown) coupled to a motor shaft of the electric motor 2 is housed in the first housing portion 81. The worm rotates coaxially with the motor shaft. The second housing portion 82 is arranged adjacent to a peripheral side portion of the first housing portion 81, and is formed into a cylindrical shape having an axis orthogonal to a cylindrical axis of the first housing portion 81. Further, the second housing portion 82 has an opening on an upper end side thereof. Note that, an internal space of the first housing portion 81 and an internal space of the second housing portion 82 communicate to each other at adjacent locations of both the housing portions.

The third housing portion 83 is arranged and formed at an upper portion of the second housing portion 82. The third housing portion 83 has a bottom surface 83*a* extending substantially horizontally to the right of FIG. 3 from an edge of the upper end opening of the second housing portion 82, and a side wall 83*b* held upright from a peripheral edge of the bottom surface 83*a*. Thus, as can be seen from FIG. 3, a circular space S recessed from the bottom surface 83*a* of the third housing portion 83 corresponds to the space of the second housing portion 82. The third housing portion 83 has an opening at an upper end thereof, and the opening is closed by the lid 84. The lid 84 is fixed to the third housing portion 83 by fastening means (not shown). In the third housing portion 83, a retention spring housing partition wall 83*c* for housing a retention spring 74 described later is formed into an arc shape along the space S.

As illustrated in FIG. 3, a cylindrical boss 82*a* is formed at a center part of a bottom surface of the second housing portion 82. The output shaft 3 is inserted through a circular hole formed in the boss 82*a*. The output shaft 3 enters the internal spaces of the second housing portion 82 and the third housing portion 83. The output shaft 3 has a tip end portion 31 and a base end portion 32, and an output gear portion 33, a shaft portion 34, and an engagement portion 35 are formed in the stated order in a region from the base end portion 32 to the tip end portion 31. As described above, the output gear portion 33 meshes with the sector gear 92 of the drive force transmission mechanism 9, and the rotational drive force of the output shaft 3 is transmitted to the drive force transmission mechanism 9. The engagement portion 35 is formed into a substantially cross shape in cross-section and is fitted into a driven plate 63 described later. The shaft portion 34, the engagement portion 35, and the tip end portion 31 enter the internal spaces of the second housing portion 82 and the third housing portion 83. The tip end portion 31 is inserted into a recessed portion 84*a*, which is formed in an inner surface of the lid 84 (surface facing the internal space of the housing 8). Accordingly, the output shaft 3 is supported by the housing 8 so as to be rotatable and axially immovable.

The detection unit 5 is housed in the housing 8. The detection unit 5 includes an object pinching detection unit 6 and a position detection unit 7. The object pinching detection unit 6 is disposed in the second housing portion 82. The object pinching detection unit 6 includes a worm wheel 61, a drive force transmission spring 62, the driven plate 63, a washer 64, an object pinching detection plate 65, an object pinching detection switch 66, and a flat spring 67.

The worm wheel 61 is arranged at a lowermost portion of the internal space S of the second housing portion 82 in FIG. 3. The worm wheel 61 is formed into a cylindrical shape. Further, the worm wheel 61 has an outer peripheral wall portion 61*a* having teeth (for example, helical teeth) formed on an outer peripheral side thereof, a cylindrical inner peripheral wall portion 61*c* having a circular hole 61*b* formed in an inner periphery thereof, and a ring-like bottom surface portion 61*d* coupling together a lower end of the outer peripheral wall portion 61*a* and a lower end of the inner peripheral wall portion 61*c*. The boss 82*a* of the second housing portion 82 is fitted into the circular hole 61*b*, and hence the worm wheel 61 is rotatably supported by the second housing portion 82. The output shaft 3 is inserted through the circular hole 61*b*. Further, the teeth formed in the outer peripheral wall portion 61*a* mesh with the worm housed in the first housing portion 81. The worm wheel 61 and the worm constitute a worm reduction gear. Thus, when the worm rotates, the rotation is transmitted to the worm wheel 61, and the worm wheel 61 performs reduced rotation about the output shaft 3 as a center shaft.

A locking portion 611 is formed in the worm wheel 61. The locking portion 611 is held upright from the bottom surface portion 61*d*, and has a height larger than the height of the outer peripheral wall portion 61*a*. Further, a plurality of (in this embodiment, four) protruding pieces 612 formed into a projecting shape along a circumferential direction of the outer peripheral wall portion 61*a* are provided at regular intervals on an upper end surface of the outer peripheral wall portion 61*a*. Each of the protruding pieces 612 is formed into an arc shape along the outer peripheral wall portion 61*a*. One end portion of each of the protruding pieces 612 is formed into a tapered shape as illustrated in FIG. 3.

The drive force transmission spring 62 is disposed above the bottom surface portion 61*d* of the worm wheel 61. The drive force transmission spring 62 is formed into an arc shape along the bottom surface portion 61*d*, and is locked at one end thereof by the locking portion 611.

The driven plate 63 is formed into a substantially disk shape, in which a part of the driven plate 63 in a circumferential direction thereof is cut out into a fan shape. The driven plate 63 has a large-diameter portion 63*b* having a large diameter and a small-diameter portion 63*c* having a small diameter, which are arranged with the part cut out into the fan shape as a border therebetween. A cross-like through-hole 63*a* is formed at a center portion of the driven plate 63. The engagement portion 35 of the output shaft 3 is fitted into the cross-like through-hole 63*a*. Accordingly, the driven plate 63 is coupled to the output shaft 3 so as to be rotatable integrally with the output shaft 3. Further, the driven plate 63 has its axial movement regulated by the washer 64 arranged at an upper portion of the driven plate 63. In the second housing portion 82, the driven plate 63 having such a shape is coaxially disposed above the worm wheel 61. At this time, the locking portion 611 formed in the worm wheel 61 protrudes through a gap formed by the part of the driven plate 63 cut out into the fan shape, and accordingly interference between the locking portion 611 and the driven plate 63 is prevented. Further, a first protruding piece 63*d* is formed in the driven plate 63 so as to extend, in FIG. 3, downward from one of circumferential end portions (cutout end portions) of the large-diameter portion 63*b*, and a second protruding piece 63*e* is formed in the driven plate 63 so as to extend, in FIG. 3, upward from another of the circumferential end portions of the large-diameter portion 63*b*. Another end of the drive force transmission spring 62 disposed in the worm wheel 61 is engaged with the first protruding piece 63*d*. Thus, the drive force transmission spring 62 engages with the locking portion 611 of the worm wheel 61 at the one end and engages with the first protruding piece 63*d* of the driven plate 63 at the another end. Further, as illustrated in FIG. 3, an arc-like long hole 63*f* extending along the circumferential direction is formed in the large-diameter portion 63*b* of the driven plate 63.

The object pinching detection plate 65 includes a rotary plate 651 formed into a stepped disk shape, and a plurality of protruding pieces 652 provided at regular intervals and formed into a projecting shape along a circumferential direction of the rotary plate 651 in the vicinity of an outer peripheral edge of a lower surface of the rotary plate 651 in FIG. 3. A circular hole for inserting the output shaft 3 therethrough is formed at the center of the rotary plate 651. Further, a projecting portion 651*a* having an arc shape in cross-section is formed on the lower surface side of the rotary plate 651. The projecting portion 651*a* has a cross-section that is formed into the same shape as the long hole 63*f* formed in the driven plate 63. The object pinching detection plate 65 is coaxially placed on the driven plate 63 so that the projecting portion 651*a* is fitted into the long hole 63*f*. Accordingly, the object pinching detection plate 65 is coupled to the driven plate 63 so as to be integrally rotatable and axially movable, and both the plates 63 and 65 integrally rotate about the output shaft 3 as a center shaft.

Further, an arc-like long hole 651*b* is formed in the rotary plate 651 along the circumferential direction thereof. When the object pinching detection unit 6 is housed in the second housing portion 82, the second protruding piece 63*e* formed in the driven plate 63 and the locking portion 611 formed in the worm wheel 61 protrude through the long hole 651*b*.

The plurality of protruding pieces 652 are provided along the circumferential direction of the rotary plate 651. Distances in a radial direction from the center of the rotary plate 651 to the protruding pieces 652 are equal to one another. Each of the protruding pieces 652 is formed into an arc shape along the circumferential direction of the rotary plate 651. Further, one end surface of each of the protruding pieces 652 in a longitudinal direction thereof is formed into a tapered shape. The number of the protruding pieces 652 is equal (in this embodiment, four) to the number of the protruding pieces 612 formed on the outer peripheral wall portion 61*a* of the worm wheel 61. The distance in the radial direction from the center of the rotary plate 651 to each of the protruding pieces 652 is equal to a distance in the radial direction from the center of the worm wheel 61 to each of the protruding pieces 612 formed on the outer peripheral wall portion 61*a*. Thus, when the assembly of the object pinching detection plate 65 and the driven plate 63 is placed above the worm wheel 61, the protruding pieces 652 face the upper end surface of the outer peripheral wall portion 61*a* of the worm wheel 61. When the worm wheel 61 and the object pinching detection plate 65 rotate about the output shaft 3, the protruding pieces 652 and the protruding pieces 612 rotate concyclically. Further, when the worm wheel 61 and the object pinching detection plate 65 rotate relative to each other, the protruding pieces 612 and the protruding pieces 652 interfere with each other. In this case, in a case where both the protruding pieces 612 and 652 interfere with each other when the worm wheel 61 rotates in the arrow X direction in FIG. 3 and the object pinching detection plate 65 does not rotate, the tapered surfaces of both the protruding pieces 612 and 652 engage with each other. The relative rotation is allowed by the engagement and the object pinching detection plate 65 is pushed up.

The flat spring 67 has a ring-like part, and plate-like parts radially extending from the ring-like part. The output shaft 3 is inserted through the ring-like part. The flat spring 67 is interposed between the object pinching detection plate 65 and an operation lever 73 described later. Thus, an elastic force of the flat spring 67 acts on the object pinching detection plate 65. By the elastic force, the object pinching detection plate 65 is pressed against the driven plate 63 via the washer 64.

Figure 4:
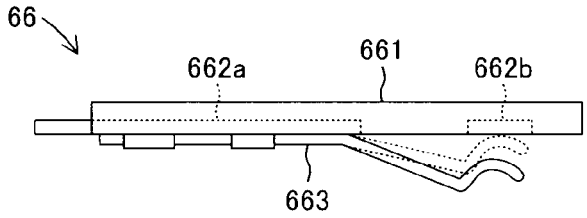
FIG. 4 is a schematic side view of an object pinching detection switch.

FIG. 4 is a schematic side view of the object pinching detection switch 66. As can be seen from FIG. 4, the object pinching detection switch 66 includes a substrate 661, a first conductive portion 662*a* and a second conductive portion 662*b* formed on the substrate 661, and a movable piece 663 connected at one end thereof to the first conductive portion 662*a*. When a tip end of the movable piece 663 is spaced apart from the substrate 661 as indicated by the solid line, the first conductive portion 662*a* and the second conductive portion 662*b* are held in a non-conductive state. On the other hand, when the tip end of the movable piece 663 is pressed and is brought into contact with the second conductive portion 662*b* on the substrate 661 as indicated by the broken line, the first conductive portion 662*a* and the second conductive portion 662*b* are brought into a conductive state via the movable piece 663. When the first conductive portion 662*a* and the second conductive portion 662*b* are held in the non-conductive state, a switching state of the object pinching detection switch 66 is an OFF state, and when the first conductive portion 662*a* and the second conductive portion 662*b* are held in the conductive state, the switching state of the object pinching detection switch 66 is an ON state.

The object pinching detection switch 66 is arranged immediately above the object pinching detection plate 65 in FIG. 3 so that the movable piece 663 thereof faces the object pinching detection plate 65, and a position of the object pinching detection switch 66 is fixed by fixing means (not shown). Thus, the switching state of the object pinching detection switch 66 changes through upward and downward movements of the object pinching detection plate 65. The object pinching detection switch 66 may be formed on the inner surface side of the lid 84.

Note that, a lubricant such as grease is generally applied to a meshing surface between the worm and the worm wheel 61. In order to prevent the grease from flying, a flying prevention plate 4 is provided. The flying prevention plate 4 is placed at a position on the bottom surface 83*a* of the third housing portion 83, at which the flying prevention plate 4 surrounds the space S in the second housing portion 82.

Figure 5:
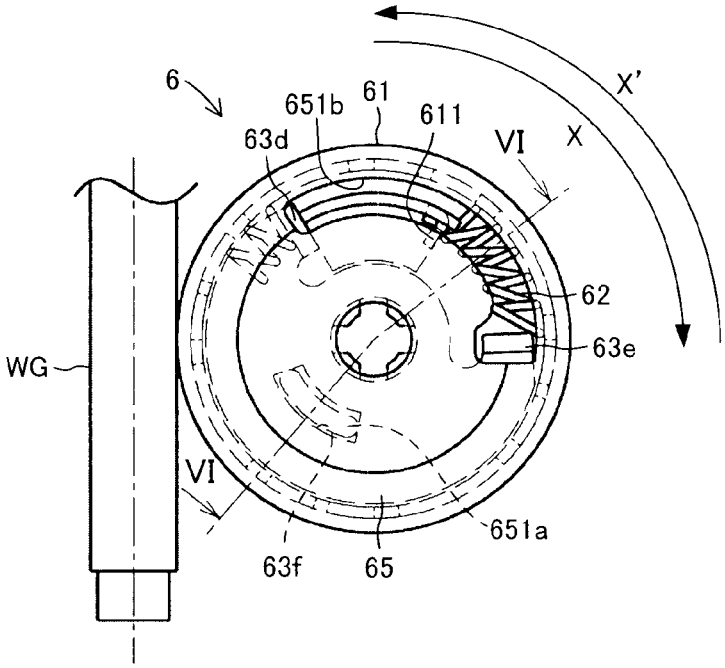
FIG. 5 is a front view of an object pinching detection unit.
Figure 6:
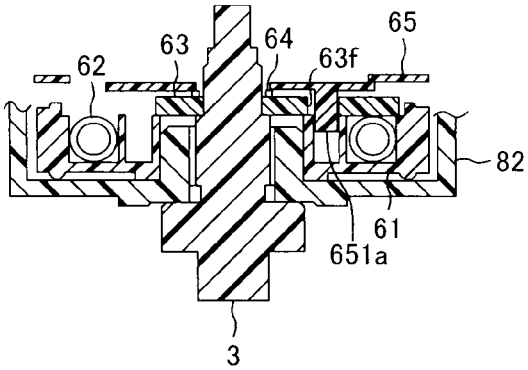
FIG. 6 is a sectional view taken along the line VI-VI of FIG. 5.

FIG. 5 is a front view of the object pinching detection unit 6 obtained by assembling the respective components. FIG. 6 is a sectional view taken along the line VI-VI of FIG. 5. As can be seen from FIG. 5, the worm wheel 61 meshes with a worm WG housed in the first housing portion 81. When the worm wheel 61 rotates in the X direction of FIG. 5 (the X direction is the same as the X direction of FIG. 3), the drive force transmission spring 62, which is locked at one end thereof by the locking portion 611 formed in the worm wheel 61, is pressed in the X direction, and the driven plate 63, which locks another end of the drive force transmission spring 62 by the first protruding piece 63*d*, is pressed in the X direction by the drive force transmission spring 62.

The position detection unit 7 corresponds to open/close position detection means of the present invention. The position detection unit 7 is disposed in the third housing portion 83. As illustrated in FIG. 3, the position detection unit 7 includes a first gear 71, a second gear 72, the operation lever 73, the retention spring 74, an insensitive area detection switch 75, a reverse operation area detection switch 76, a coupling pin 77, and a stopper 73*g* mounted onto the third housing portion 83. A circular hole is formed at the center of the first gear 71. The output shaft 3 is fitted into the circular hole, and accordingly the first gear 71 is supported by the output shaft 3 so as to be rotatable integrally therewith. The second gear 72 is arranged at a position at which the second gear 72 meshes with the first gear 71. As can be seen from FIG. 3, the number of teeth of the second gear 72 is larger than the number of teeth of the first gear 71. Thus, the second gear 72 reduces the rotation speed of the first gear 71. Further, a cam 72*a* having a projecting shape is formed on an upper surface of the second gear 72 in FIG. 3. The cam 72*a* has a predetermined length along a circumferential direction of the second gear 72, and is formed into an arc shape along the circumferential direction. Further, a columnar projecting portion 72*b* is formed on a lower surface of the second gear 72 in FIG. 3. The projecting portion 72*b* corresponds to an engagement member of the present invention, which is engageable with the operation lever 73. Further, a circular hole is formed at the center of the second gear 72, and the coupling pin 77 is inserted through the circular hole. The second gear 72 is rotatably supported by the coupling pin 77.

Figure 7:
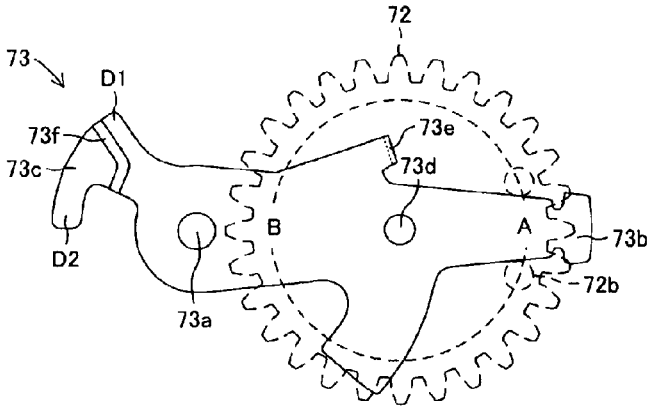
FIG. 7 is a front view of an operation lever according to the first embodiment.

The operation lever 73 is disposed below the first gear 71 and the second gear 72 in FIG. 3, and is formed into an elongated flat plate shape. FIG. 7 is a front view of the operation lever 73. As can be seen from FIG. 7, a first circular hole 73*a* for inserting the output shaft 3 therethrough is formed in the operation lever 73. The output shaft 3 is inserted through the first circular hole 73*a*, and accordingly the operation lever 73 is supported by the output shaft 3 so as to be rotatable relative to the output shaft 3. Note that, after the output shaft 3 is inserted through the first circular hole 73*a*, the output shaft 3 is inserted through the circular hole formed in the first gear 71.

Further, the operation lever 73 has a first arm portion 73*b* extending toward one side (right side of FIG. 7) in a longitudinal direction thereof from the first circular hole 73*a*, and a second arm portion 73*c* extending toward the other side (left side of FIG. 7). A second circular hole 73*d* is formed substantially at the center of the first arm portion 73*b*. Through the second circular hole 73*d*, the coupling pin 77, which is inserted through the second gear 72, is inserted. The operation lever 73 is coupled to the second gear 72 via the coupling pin 77. Thus, the operation lever 73 is supported by the output shaft 3, which rotates integrally with the first gear 71, so as to be rotatable relative to the output shaft 3, and is coupled to the second gear 72 via the coupling pin 77. As illustrated in FIG. 7, the second gear 72 is rotatably arranged at a position immediately above the first arm portion 73*b* of the operation lever 73. The first arm portion 73*b* is formed into a rugged shape so that, when the second gear 72 rotates, the projecting portion 72*b* formed on the lower surface of the second gear 72 engages with a tip end part A of the first arm portion 73*b* and does not engage with a base end part B thereof. Further, a locking portion 73*e* is formed in the first arm portion 73*b*. The locking portion 73*e* locks one end of the retention spring 74 described later. Further, a step 73*f* is formed at a tip end part of the second arm portion 73*c*. When an axial direction of the first circular hole 73*a* is defined as a height direction, the height of one part D1 and the height of another part D2, which sandwich the step 73*f*, are different from each other.

The retention spring 74 is housed in the retention spring housing partition wall 83*c* that is formed in the third housing portion 83. As illustrated in FIG. 3, the retention spring housing partition wall 83*c* is formed of two arc-like walls that are formed concentrically, and a bottom wall closing one end side of the arc-like walls, and the retention spring housing partition wall 83*c* has an opening on another end side thereof. The retention spring 74 housed in such a retention spring housing partition wall 83*c* is locked at one end thereof by the locking portion 73*e* of the operation lever 73 as described above, and is locked at another end thereof by the bottom wall of the retention spring housing partition wall 83*c*. Thus, the operation lever 73 is biased by a stretching force that is generated by the retention spring 74 so as to rotate about the first circular hole 73*a*, but this rotation is regulated when the tip end part of the first arm portion 73*b* of the operation lever 73 engages with the stopper 73*g* provided in the third housing portion 83. Through the regulation, the operation lever 73 is aligned.

Figure 8:
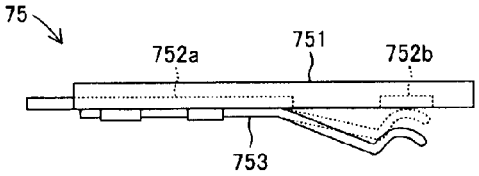
FIG. 8 is a schematic side view of an insensitive area detection switch.
Figure 9:
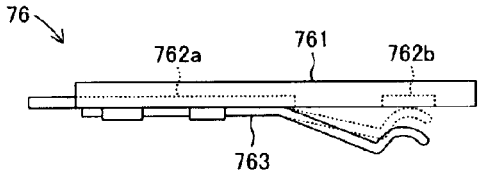
FIG. 9 is a schematic side view of a reverse operation area detection switch.

FIG. 8 is a schematic side view of the insensitive area detection switch 75. FIG. 9 is a schematic side view of the reverse operation area detection switch 76. Similarly to the object pinching detection switch 66, the switches 75 and 76 respectively include substrates 751 and 761, first conductive portions 752*a* and 762*a* and second conductive portions 752*b* and 762*b* respectively formed on the substrates 751 and 761, and movable pieces 753 and 763 respectively connected at one end thereof to the first conductive portions 752*a* and 762*a*. When tip ends of the movable pieces 753 and 763 are respectively spaced apart from the substrates 751 and 761 as indicated by the solid lines, the first conductive portions 752*a* and 762*a* and the second conductive portions 752*b* and 762*b* are held in a non-conductive state, respectively. On the other hand, when the tip ends of the movable pieces 753 and 763 are respectively pressed and brought into contact with the second conductive portions 752*b* and 762*b* on the substrates 751 and 761 as indicated by the broken lines, the first conductive portions 752*a* and 762*a* and the second conductive portions 752*b* and 762*b* are brought into a conductive state via the movable pieces 753 and 763, respectively. When the first conductive portions 752*a* and 762*a* and the second conductive portions 752*b* and 762*b* are respectively held in the non-conductive state, the switching state of the switches 75 and 76 is an OFF state, and when the first conductive portions 752*a* and 762*a* and the second conductive portions 752*b* and 762*b* are respectively held in the conductive state, the switching state of the switches 75 and 76 is an ON state.

As can be seen from FIG. 3, the insensitive area detection switch 75 is disposed immediately above the operation lever 73. Specifically, the insensitive area detection switch 75 is fixed at such a position that, when the operation lever 73 rotates about the first circular hole 73*a*, the tip end portion of the movable piece 753 climbs over the step 73*f* formed at the tip end of the second arm portion 73*c* of the operation lever 73. When the operation lever 73 is viewed from the insensitive area detection switch 75 fixed at such a position, of the one part D1 and the another part D2 sandwiching the step 73*f* of the second arm portion 73*c* of the operation lever 73, the one part D1 is closer to the insensitive area detection switch 75 as compared to the another part D2. That is, in FIG. 3, the height position of the part D1 is higher than the height position of the part D2. When the tip end part of the movable piece 753 is held in contact with the part D1, the movable piece 753 is pressed and the tip end portion thereof is brought into contact with the second conductive portion 752*b* on the substrate 751, with the result that the switching state of the insensitive area detection switch 75 becomes the ON state. On the other hand, when the tip end portion of the movable piece 753 is held in contact with the part D2, the tip end portion of the movable piece 753 is spaced apart from the second conductive portion 752*b* on the substrate 751, with the result that the switching state of the insensitive area detection switch 75 becomes the OFF state. The insensitive area detection switch 75 corresponds to a specific positional area detection switch of the present invention.

The reverse operation area detection switch 76 is disposed immediately above the second gear 72. Specifically, the reverse operation area detection switch 76 is fixed at such a position that, when the second gear 72 rotates, the tip end portion of the movable piece 763 may be brought into contact with the cam 72*a* formed on the second gear 72 over a length direction thereof. When the tip end portion of the movable piece 763 is held in contact with the cam 72*a*, the tip end portion of the movable piece 763 is pressed by the cam 72*a* and is brought into contact with the second conductive portion 762*b* on the substrate 761, with the result that the switching state of the reverse operation area detection switch 76 becomes the ON state. On the other hand, when the tip end of the movable piece 763 is not held in contact with the cam 72*a*, the tip end portion of the movable piece 763 is spaced apart from the second conductive portion 762*b* on the substrate 761, with the result that the switching state of the reverse operation area detection switch 76 becomes the OFF state. Note that, the insensitive area detection switch 75 and the reverse operation area detection switch 76 may be formed directly on the lid 84.

In the window regulator device structured as described above, when the rotation of the electric motor 2 is transmitted to the worm wheel 61 and the worm wheel 61 rotates in the arrow X direction of FIGS. 3 and 5, the drive force transmission spring 62, which is locked at one end thereof by the locking portion 611 formed in the worm wheel 61, is pressed and the drive force transmission spring 62 also rotates in the X direction. When the drive force transmission spring 62 rotates in the X direction, the driven plate 63, which locks another end of the drive force transmission spring 62 by the first protruding piece 63*d*, also rotates in the X direction. The driven plate 63 is coupled to the output shaft 3 so as to be rotatable integrally with the output shaft 3, and thus, along with the rotation of the driven plate 63, the output shaft 3 also rotates in the X direction. The X-directional rotation of the output shaft 3 corresponds to the clockwise rotation of the output shaft 3 in FIG. 1. Thus, through the rotation of the output shaft 3, the lift arm 93 of the drive force transmission mechanism 9 rotates counterclockwise in FIG. 1. Accordingly, the window glass W is closed.

On the other hand, when the worm wheel 61 rotates in an arrow X' direction of FIGS. 3 and 5, the locking portion 611 moves in a direction in which the locking portion 611 is spaced apart from the drive force transmission spring 62, and then engages with the first protruding piece 63*d* of the driven plate 63. Through the engagement, the rotational drive force of the worm wheel 61 is transmitted directly to the driven plate 63 without intermediation of the drive force transmission spring 62. Therefore, the driven plate 63 rotates in the X' direction, and along with the rotation, the object pinching detection plate 65 and the output shaft 3 rotate in the X' direction. The X'-directional rotation of the output shaft 3 corresponds to the counterclockwise rotation of the output shaft 3 in FIG. 1. Thus, through the rotation of the output shaft 3, the lift arm 93 of the drive force transmission mechanism 9 rotates clockwise in FIG. 1. Accordingly, the window glass W is opened.

Figure 10:
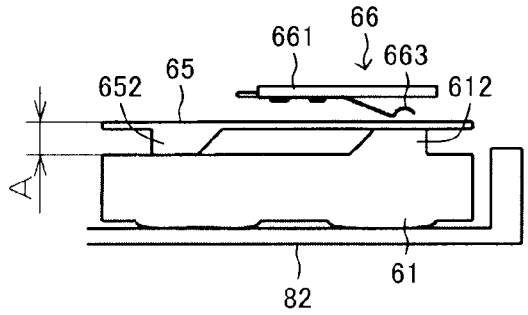
FIG. 10 is a schematic side view illustrating an operation state of a worm wheel and an object pinching detection plate in a case where a foreign object is not pinched.

Next, a switching operation of the object pinching detection switch 66 is described. When the foreign object is not pinched between the window glass W and the window frame at the time of the closing operation of the window glass W, the rotational drive force of the electric motor 2 is transmitted to the output shaft 3 with no change. At this time, the worm wheel 61 and the object pinching detection plate 65 integrally rotate in synchronization. FIG. 10 is a schematic side view illustrating an operation state of the worm wheel 61 and the object pinching detection plate 65 in this case. When the worm wheel 61 and the object pinching detection plate 65 rotate in synchronization, as illustrated in FIG. 10, the distance between the protruding piece 612 formed on the worm wheel 61 and the protruding piece 652 formed on the object pinching detection plate 65 does not change. Therefore, both the protruding pieces 612 and 652 do not interfere with each other and rotate concyclically under a state in which a constant interval is maintained therebetween. Further, the tip end portion of the movable piece 663 of the object pinching detection switch 66, which is placed at an upper portion of the object pinching detection plate 65, is not held in contact with the object pinching detection plate 65, and therefore the tip end portion of the movable piece 663 is not brought into contact with the second conductive portion 662*b* formed on the substrate 661. That is, when the foreign object is not pinched, the switching state of the object pinching detection switch 66 is the OFF state.

Figure 11:
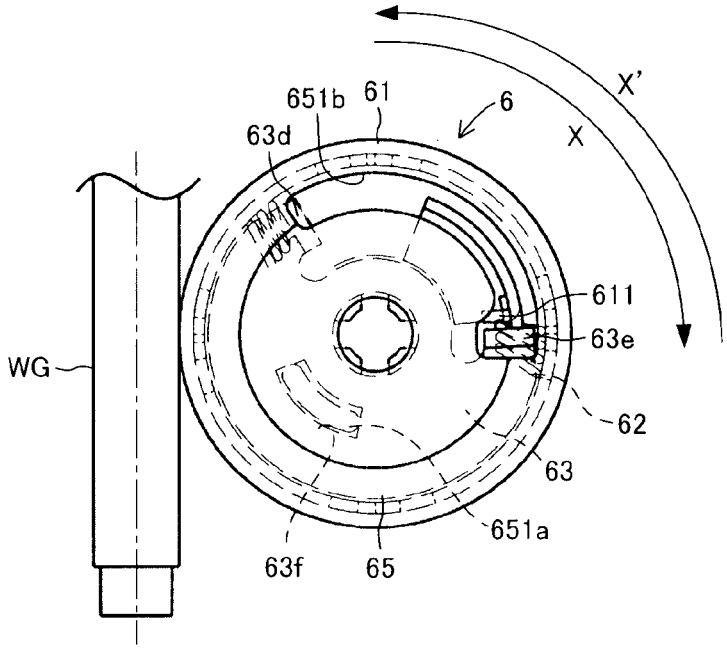
FIG. 11 is a front view of the object pinching detection unit, illustrating an operation state at the time when a drive force transmission spring is compressed.

On the other hand, when the foreign object is pinched between the window glass W and the window frame at the time of the closing operation of the window glass W, the closing operation (raising) of the window glass W is interrupted due to the presence of the foreign object. Therefore, the rotation of the output shaft 3 is stopped. Along with the stop of rotation of the output shaft 3, the rotation of the driven plate 63 and the object pinching detection plate 65 is also stopped. However, the worm wheel 61 continues to rotate in the X direction of FIGS. 3 and 5 in response to the rotational drive force of the electric motor 2. Therefore, the worm wheel 61 rotates in the X direction relative to the driven plate 63 and the object pinching detection plate 65. At this time, the first protruding piece 63*d* formed in the driven plate 63 is stopped, whereas the locking portion 611 formed in the worm wheel 61 rotates. Therefore, the drive force transmission spring 62 sandwiched between the first protruding piece 63*d* and the locking portion 611 is compressed through the X-directional rotation of the locking portion 611. That is, the drive force transmission spring 62 is compressed, and accordingly the X-directional rotation of the worm wheel 61 relative to the driven plate 63 and the object pinching detection plate 65 is allowed. FIG. 11 is a front view of the object pinching detection unit 6, illustrating an operation state at the time when the drive force transmission spring 62 is compressed. Note that, when the locking portion 611 rotates in the X direction relative to the driven plate 63, the locking portion 611 is then locked by the second protruding piece 63*e* formed in the driven plate 63. Accordingly, further relative rotation of the worm wheel 61 is regulated.

Figure 12:
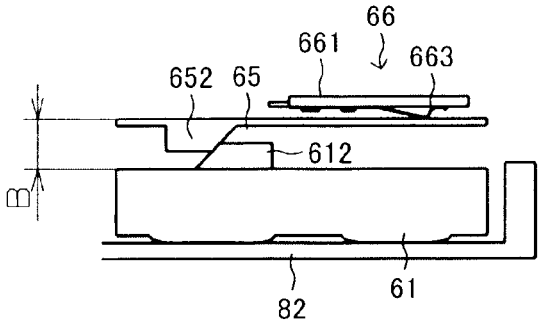
FIG. 12 is a schematic side view illustrating a state in which protruding pieces formed on the worm wheel and the object pinching detection plate interfere with each other.

When the worm wheel 61 rotates in the X direction relative to the object pinching detection plate 65, the distance between the protruding piece 612 formed on the worm wheel 61 and the protruding piece 652 formed on the object pinching detection plate 65 is reduced, and then both the protruding pieces interfere with each other. FIG. 12 is a side view illustrating a state in which both the protruding pieces 612 and 652 interfere with each other. As illustrated in FIG. 12, both the protruding pieces 612 and 652 engage with each other at the respective tapered surfaces thereof. Through the engagement, the protruding piece 652 of the object pinching detection plate 65 overrides the protruding piece 612 of the worm wheel 61. Accordingly, the object pinching detection plate 65 is pushed upward. In this case, a plurality of (four) protruding pieces 612 and a plurality of (four) protruding pieces 652 are provided, and the respective protruding pieces are arranged at regular intervals. Therefore, the plurality of protruding pieces 652 simultaneously override the plurality of protruding pieces 612. Thus, the object pinching detection plate 65 is pushed upward, while maintaining the horizontal state without being inclined in the circumferential direction.

When the object pinching detection plate 65 is pushed upward through the engagement between the protruding pieces 612 and 652, as illustrated in FIG. 12, an upper surface of the object pinching detection plate 65 presses the movable piece 663 of the object pinching detection switch 66. Accordingly, the tip end portion of the movable piece 663 is brought into contact with the second conductive portion 662*b* formed on the substrate 661, with the result that the first conductive portion 662*a* and the second conductive portion 662*b* are brought into the conductive state. That is, when the foreign object is pinched, the switching state of the object pinching detection switch 66 becomes the ON state.

As can be seen from the above description, when the object pinching detection plate 65 does not axially move (is not pushed up), that is, when the pinching does not occur, the switching state of the object pinching detection switch 66 becomes the OFF state, and when the object pinching detection plate 65 axially moves (is pushed up) in the direction in which the object pinching detection plate 65 is spaced apart from the worm wheel 61, that is, when the pinching has occurred, the switching state of the object pinching detection switch 66 becomes the ON state. In other words, when the distance between the object pinching detection plate 65 and the worm wheel 61 at the time when the object pinching detection plate 65 is not pushed up is defined as "A" (see FIG. 10), and the distance between the object pinching detection plate 65 and the worm wheel 61 at the time when the object pinching detection plate 65 is pushed up is defined as "B" (see FIG. 12), the object pinching detection switch 66 is arranged at such a position that the switching state thereof becomes the OFF state when the distance corresponds to "A" and becomes the ON state when the distance corresponds to "B".

Figure 13:
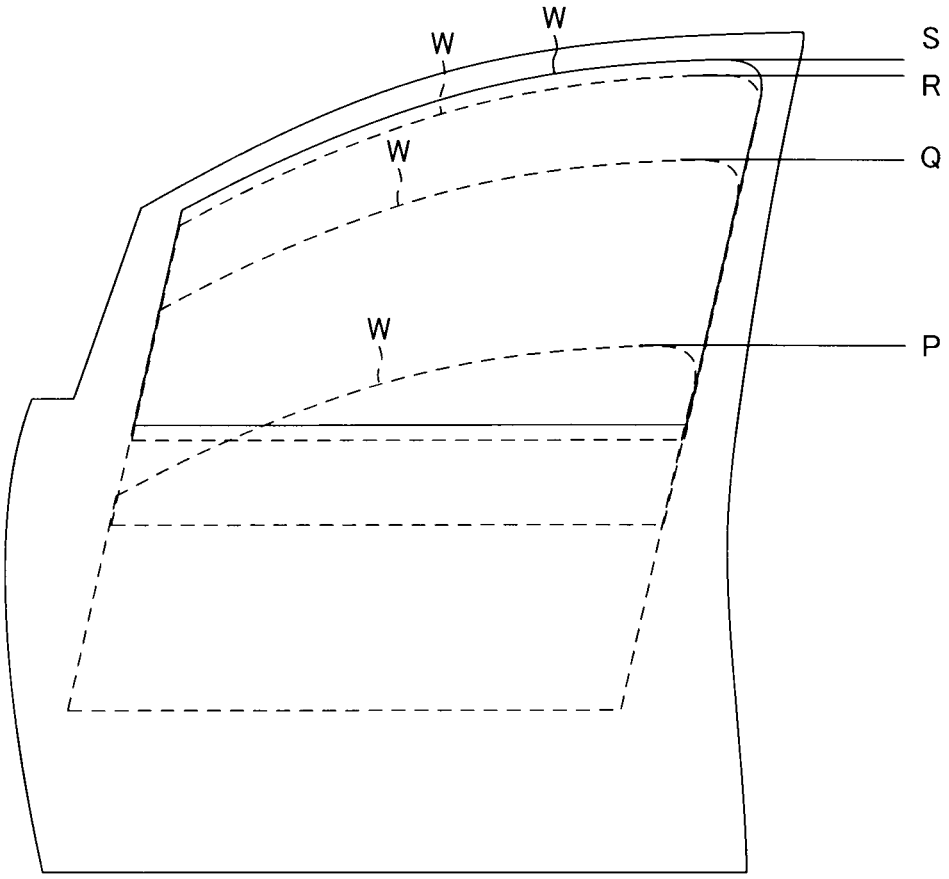
FIG. 13 is a schematic view illustrating open/close positions of the window glass.

Next, an operation of the position detection unit 7 is described. As can be seen from FIG. 3, the first gear 71 of the position detection unit 7 is coupled to the output shaft 3, and hence integrally rotates along with the rotation of the output shaft 3. When the first gear 71 rotates, the second gear 72 meshing with the first gear 71 rotates in a direction opposite to the direction of the first gear 71. Through the rotation of the second gear 72, the projecting portion 72*b* formed on the lower surface of the second gear 72 also rotates. The rotational position of the projecting portion 72*b* relative to the operation lever 73 is determined in advance in association with the open/close position of the window glass W, which changes along with the rotation of the output shaft 3. FIG. 13 is a schematic view illustrating the open/close positions of the window glass W.

In FIG. 13, each open/close position of the window glass W is represented by an upper end position of the window glass W. When the open/close position of the window glass W is the fully opened position indicated by the line P of FIG. 13, the window glass W is fully opened, and when the open/close position of the window glass W is the fully closed position indicated by the line S of FIG. 13, the window glass W is fully closed. Further, when the open/close position of the window glass W is situated within an area R-S ranging from a position in the vicinity of the fully closed position, which is indicated by the line R of FIG. 13, to the fully closed position, the upper end of the window glass W may be brought into contact with, for example, a weatherstrip provided to the window frame at the time when the window glass W is closed, which leads to a risk that the pinching of the foreign object may be erroneously detected. Such an area R-S, in which the pinching is erroneously detected immediately before the window glass W is fully closed, is herein referred to as an insensitive area. The insensitive area corresponds to a specific positional area of the present invention. Further, the open/close position indicated by the line R in FIG. 13 is herein referred to as an insensitive area start position. In this embodiment, the arrangement relationship between the projecting portion 72*b* and the operation lever 73 is set so that, when the open/close position of the window glass W is situated within an area ranging from the fully opened position to the insensitive area start position (area P-R), that is, when the open/close position of the window glass W is situated out of the insensitive area, the projecting portion 72*b* of the second gear 72 does not engage with the operation lever 73, and when the open/close position is situated within the insensitive area (area R-S), the projecting portion 72*b* engages with the operation lever 73 and accordingly the operation lever 73 is rotated.

Figure 14:
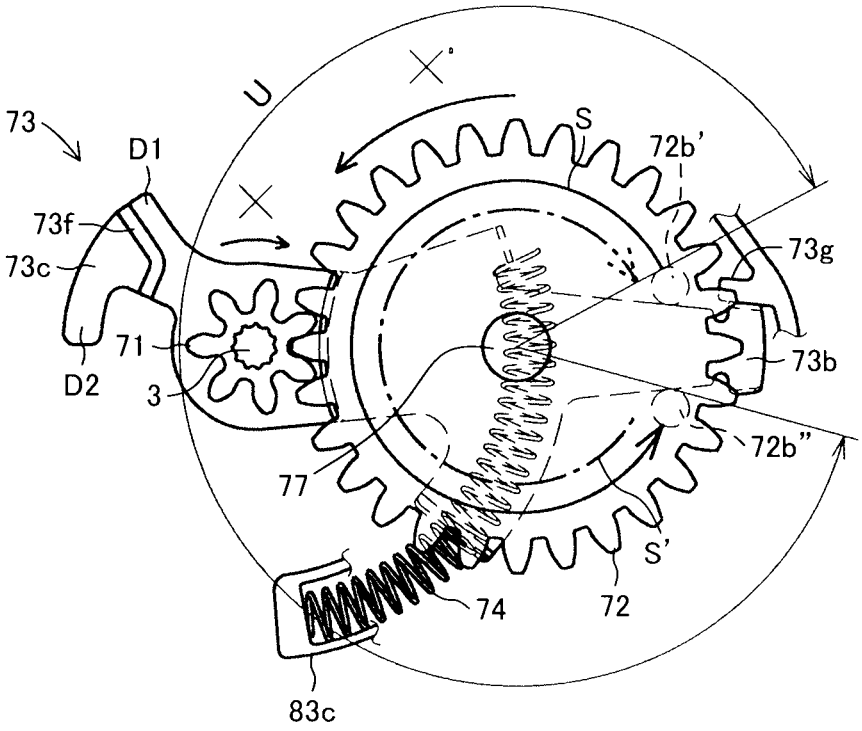
FIG. 14 is a front view illustrating an arrangement relationship among a first gear, a second gear, and the operation lever.

FIG. 14 is a front view illustrating an arrangement relationship among the first gear 71, the second gear 72, and the operation lever 73. As can be seen from FIG. 14, the retention spring 74 biases the operation lever 73 in the X' direction (counterclockwise direction) of FIG. 14. The stopper 73*g* regulates the X'-directional rotation of the operation lever 73 that is caused by the biasing force of the retention spring 74. Through the regulation of rotation, the operation lever 73 is aligned at a position illustrated in FIG. 14. The first gear 71 and the second gear 72 are assembled in a meshing state on an upper surface side of the aligned operation lever 73 (front side of FIG. 14). When the first gear 71 rotates in the X direction through the rotation of the output shaft 3, the window glass W is closed and the second gear 72 meshing with the first gear 71 rotates in the X' direction opposite to the X direction.

When the window glass W is closed in a range from the fully opened position to the insensitive area start position, the projecting portion 72*b* formed on the second gear 72 rotates in the X' direction along the solid line arrow S of FIG. 14 from a position indicated by the reference symbol 72*b*' of FIG. 14 to a position indicated by the reference symbol 72*b*" of FIG. 14. Further, when the window glass W is opened in a range from the insensitive area start position to the fully opened position, the projecting portion 72*b* rotates in a direction opposite to the X' direction along the chain line arrow S' of FIG. 14 from the position indicated by the reference symbol 72*b*" of FIG. 14 to the position indicated by the reference symbol 72*b*' of FIG. 14. The rotational area of the projecting portion 72*b* indicated by the solid line arrow S and the chain line arrow S' is represented by a rotational area U in FIG. 14. The position indicated by the reference symbol 72*b*' corresponds to a position at which the projecting portion 72*b* is brought into contact with the tip end part of the first arm portion 73*b* of the operation lever 73 on the upper side in FIG. 14. The position indicated by the reference symbol 72*b*" corresponds to a position at which the projecting portion 72*b* is brought into contact with the tip end part of the first arm portion 73*b* on the lower side in FIG. 14. Thus, when the rotational position of the projecting portion 72*b* is a position within a rotational area U, the projecting portion 72*b* does not engage with the operation lever 73. In other words, when the open/close position of the window glass W is situated in a range from the fully opened position to the insensitive area start position, that is, when the open/close position of the window glass W is situated out of the insensitive area, the second gear 72 does not engage with the operation lever 73.

Figure 15:
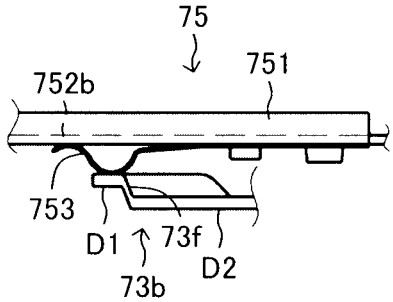
FIG. 15 is a schematic partial side view illustrating a contact state between the insensitive area detection switch and the operation lever in a case where the open/close position of the window glass is situated out of an insensitive area.

When the second gear 72 does not engage with the operation lever 73, the rotational drive force of the output shaft 3 is not transmitted to the operation lever 73, and hence the operation lever 73 is not rotated. FIG. 15 is a schematic partial side view illustrating a contact state between the insensitive area detection switch 75 and the operation lever 73 in a case where the operation lever 73 is not rotated. As illustrated in FIG. 15, the tip end portion of the movable piece 753 of the insensitive area detection switch 75 abuts against the part D1 that is higher in height position than the part D2 across the step 73*f* of the second arm portion 73*c* of the operation lever 73, and is held in contact with the second conductive portion 752*b* formed on the substrate 751 while receiving a pressing force from the part D1. Thus, when the open/close position of the window glass W is situated out of the insensitive area, the switching state of the insensitive area detection switch 75 is the ON state.

When the window glass W is further closed beyond the insensitive area start position, the projecting portion 72*b* of the second gear 72 engages with the operation lever 73 at the position indicated by the reference symbol 72*b*" of FIG. 14 (this position is located farther from a position at which the operation lever 73 is supported by the output shaft 3 than the position to which the second gear 72 is coupled). In this case, the second gear 72 is coupled to the operation lever 73 via the coupling pin 77, and hence, through the engagement between the projecting portion 72*b* and the operation lever 73, the rotation of the second gear 72 relative to the operation lever 73 is stopped. However, the first gear 71 continues to rotate in the X direction, and hence the second gear 72 is rotated in the X direction about the first gear 71 due to the mesh with the first gear 71. That is, the second gear 72 revolves in the X direction (same direction as the rotational direction of the first gear 71) about the first gear 71 by the rotational force of the first gear 71. Through the X-directional revolution of the second gear 72, the operation lever 73 coupled to the second gear 72 via the coupling pin 77 is rotated in the X direction (clockwise direction) about the first gear 71 (output shaft 3) against the biasing force of the retention spring 74.

Figure 16:
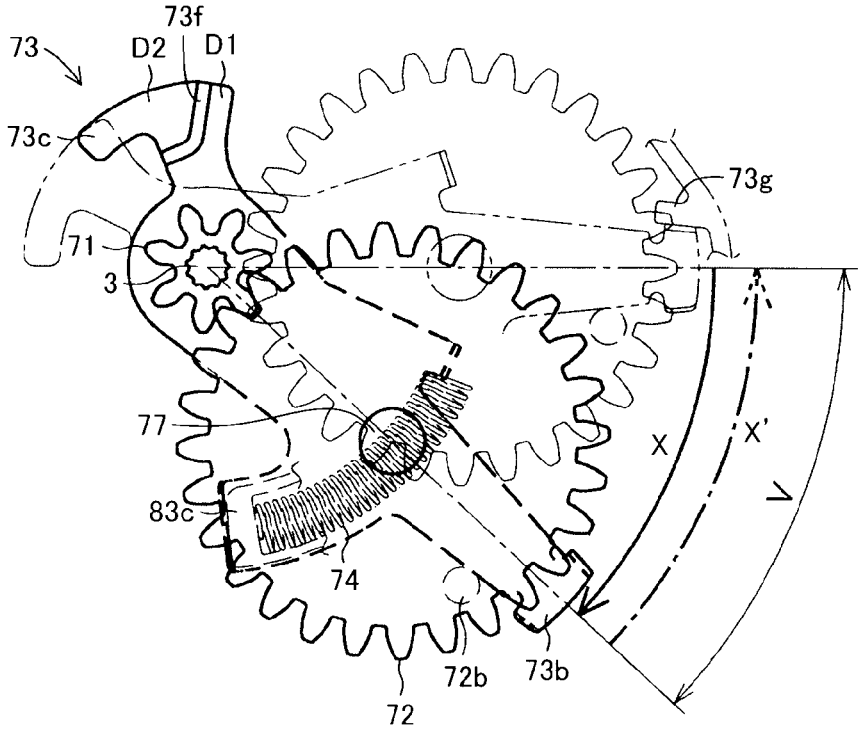
FIG. 16 is a front view illustrating an arrangement relationship among the first gear, the second gear, and the operation lever in a case where the operation lever is rotated.

FIG. 16 is a front view illustrating an arrangement relationship among the first gear 71, the second gear 72, and the operation lever 73 in a case where the operation lever 73 is rotated. When the window glass W is closed in a range from the insensitive area start position to the fully closed position, the operation lever 73 rotates in the X direction about the output shaft 3 from a position indicated by the two-dot chain line of FIG. 16 to a position indicated by the solid line (dotted line in the hidden portion) of FIG. 16, while maintaining the engaging state with the second gear 72. Conversely, when the window glass W is opened in a range from the fully closed position to the insensitive area start position, the operation lever 73 rotates in the X' direction about the output shaft 3 together with the second gear 72 from the position indicated by the solid line of FIG. 16 to the position indicated by the two-dot chain line of FIG. 16. In other words, when the open/close position of the window glass W is situated within the insensitive area, the operation lever 73 engages with the second gear 72 and is rotated within a rotational area V of FIG. 16 about the output shaft 3 together with the second gear 72.

Figure 17:
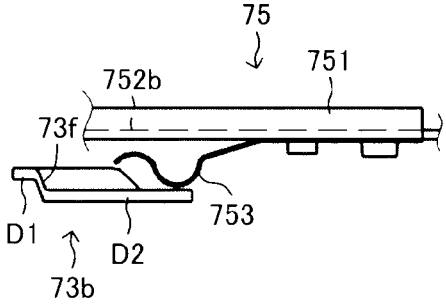
FIG. 17 is a schematic partial side view illustrating a contact state between the insensitive area detection switch and the operation lever in a case where the open/close position of the window glass is situated within the insensitive area.

FIG. 17 is a schematic partial side view illustrating a contact state between the insensitive area detection switch 75 and the operation lever 73 in a case where the operation lever 73 is rotated within the rotational area V of FIG. 16. As illustrated in FIG. 17, the tip end of the movable piece 753 of the insensitive area detection switch 75 abuts against the part D2 that is lower in height position than the part D1 across the step 73*f* of the second arm portion 73*c* immediately after the rotation of the operation lever 73, and is spaced apart from the second conductive portion 752*b*. Thus, when the open/close position of the window glass W is situated within the insensitive area, the switching state of the insensitive area detection switch 75 is the OFF state.

As described above, the insensitive area detection switch 75 performs the switching operation based on the rotational operation of the operation lever 73. Specifically, the switching state of the insensitive area detection switch 75 is the ON state when the operation lever 73 is not rotated, that is, when the open/close position of the window glass W is situated out of the insensitive area, and the switching state of the insensitive area detection switch 75 is the OFF state when the operation lever 73 is rotated, that is, when the open/close position of the window glass W is situated within the insensitive area.

The arrangement relationship between the rotational position of the cam 72*a* formed on the upper surface of the second gear 72 and the reverse operation area detection switch 76 is also associated with the open/close position of the window glass W, which changes along with the rotation of the output shaft 3. The arrangement relationship between the rotational position of the cam 72*a* and the reverse operation area detection switch 76 is determined so that, when the open/close position of the window glass W is situated within an area ranging from a position indicated by the line Q of FIG. 13 (this position is herein referred to as a reverse operation area start position) to the insensitive area start position (this area is herein referred to as a reverse operation area), the switching state of the reverse operation area detection switch 76 becomes the ON state, and when the open/close position of the window glass is situated out of the reverse operation area, the switching state of the reverse operation area detection switch 76 becomes the OFF state.

Figure 18A:
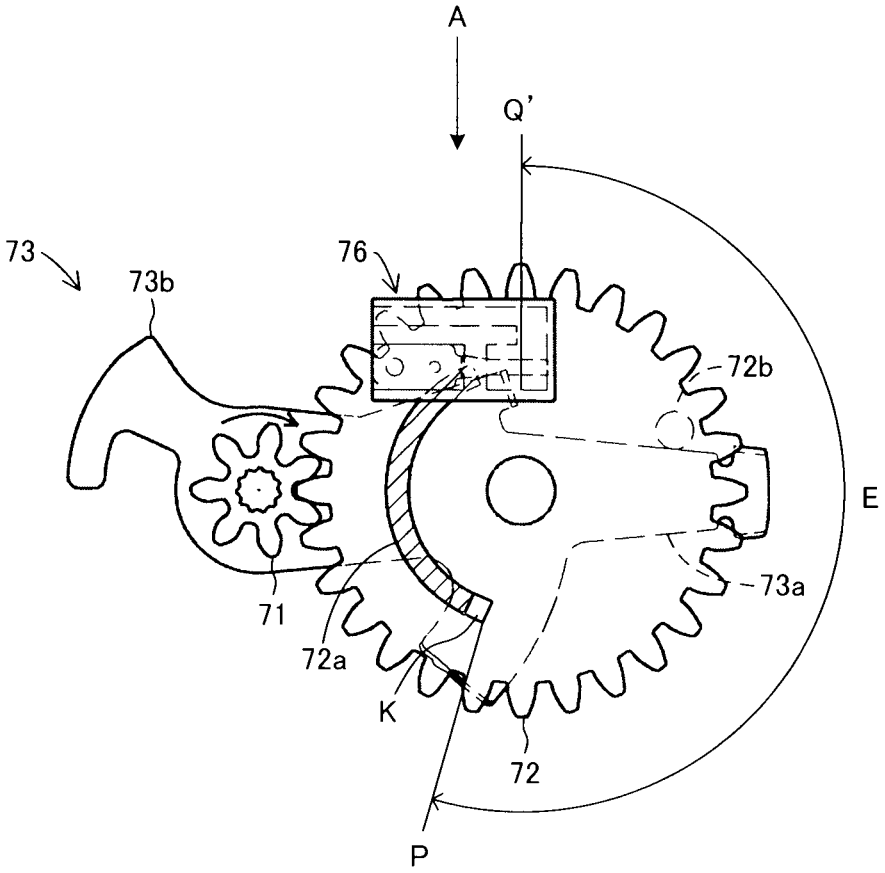
FIG. 18A is a front view illustrating an arrangement relationship between a cam and the reverse operation area detection switch at the time when the open/close position of the window glass is the fully opened position.
Figure 18B:
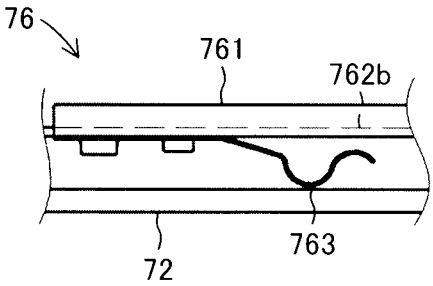
FIG. 18B is a view taken in the arrow A direction of FIG. 18A.

FIG. 18A is a front view illustrating an arrangement relationship between the rotational position of the cam 72*a* and the reverse operation area detection switch 76 at the time when the open/close position of the window glass W is the fully opened position. FIG. 18B is a view taken in the arrow A direction of FIG. 18A. When the open/close position of the window glass W is the fully opened position, the movable piece 763 of the reverse operation area detection switch 76 is held in contact with a part of the second gear 72 at which the cam 72*a* is not formed. At this time, the tip end of the movable piece 763 is not held in contact with the second conductive portion 762*b*. Thus, in this case, the switching state of the reverse operation area detection switch 76 is the OFF state.

When the window glass W is closed in a range from the fully opened position to a position immediately before the reverse operation area start position, one end portion K of the cam 72*a* in a longitudinal direction thereof rotates from a rotational position indicated by the line P of FIG. 18A to a rotational position indicated by the line Q' of FIG. 18A. Conversely, when the window glass W is opened in a range from the position immediately before the reverse operation area start position to the fully opened position, the end portion K rotates from the rotational position indicated by the line Q' of FIG. 18A to the rotational position indicated by the line P of FIG. 18A. When the rotational position of the end portion K is situated within a rotational area E ranging from the rotational position indicated by the line P to the rotational position indicated by the line Q', the movable piece 763 of the reverse operation area detection switch 76 is not brought into contact with the cam 72*a*. Thus, when the open/close position of the window glass W is situated within the area ranging from the fully opened position to the position immediately before the reverse operation area start position, that is, when the open/close position of the window glass W is situated out of the reverse operation area, the switching state of the reverse operation area detection switch 76 is the OFF state.

Figure 19A:
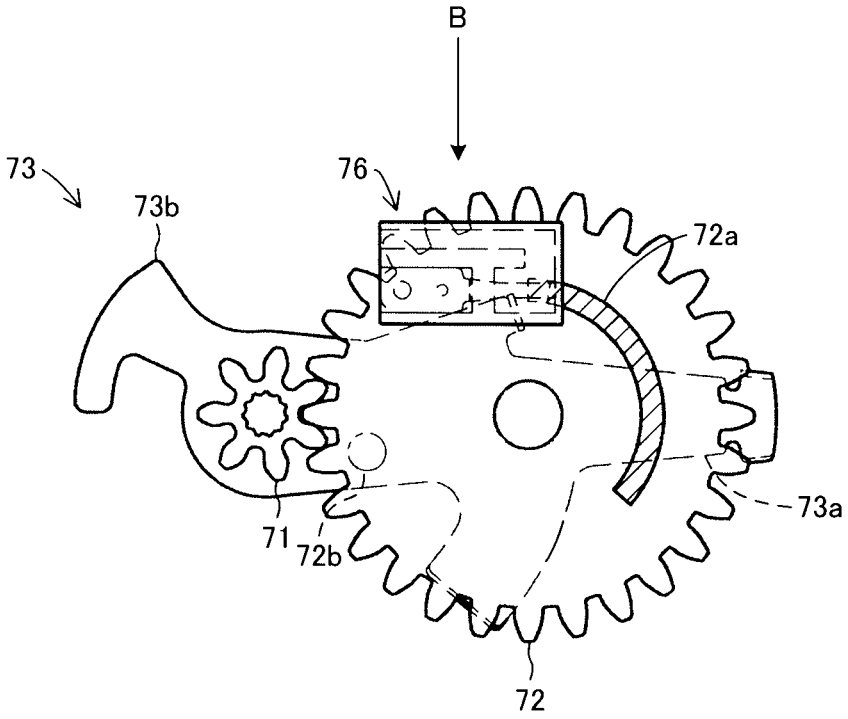
FIG. 19A is a front view illustrating an arrangement relationship between the cam and the reverse operation area detection switch at the time when the open/close position of the window glass is a reverse operation area start position.
Figure 19B:
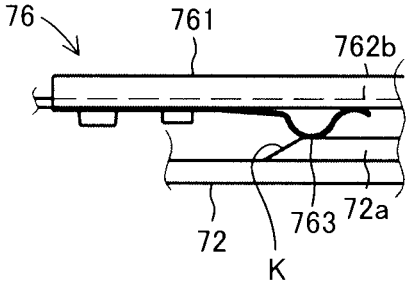
FIG. 19B is a view taken in the arrow B direction of FIG. 19A.

FIG. 19A is a front view illustrating an arrangement relationship between the rotational position of the cam 72*a* and the reverse operation area detection switch 76 at the time when the open/close position of the window glass W is the reverse operation area start position. FIG. 19B is a view taken in the arrow B direction of FIG. 19A. As illustrated in FIGS. 19A and 19B, when the open/close position of the window glass W is the reverse operation area start position, the movable piece 763 of the reverse operation area detection switch 76 starts to override the end portion K of the cam 72*a*. Therefore, the tip end of the movable piece 763 is pressed by the cam 72*a* and is brought into contact with the second conductive portion 762*b*, with the result that the first conductive portion 762*a* and the second conductive portion 762*b* are brought into conduction. Accordingly, the switching state of the reverse operation area detection switch 76 is switched into the ON state.

Figure 20A:
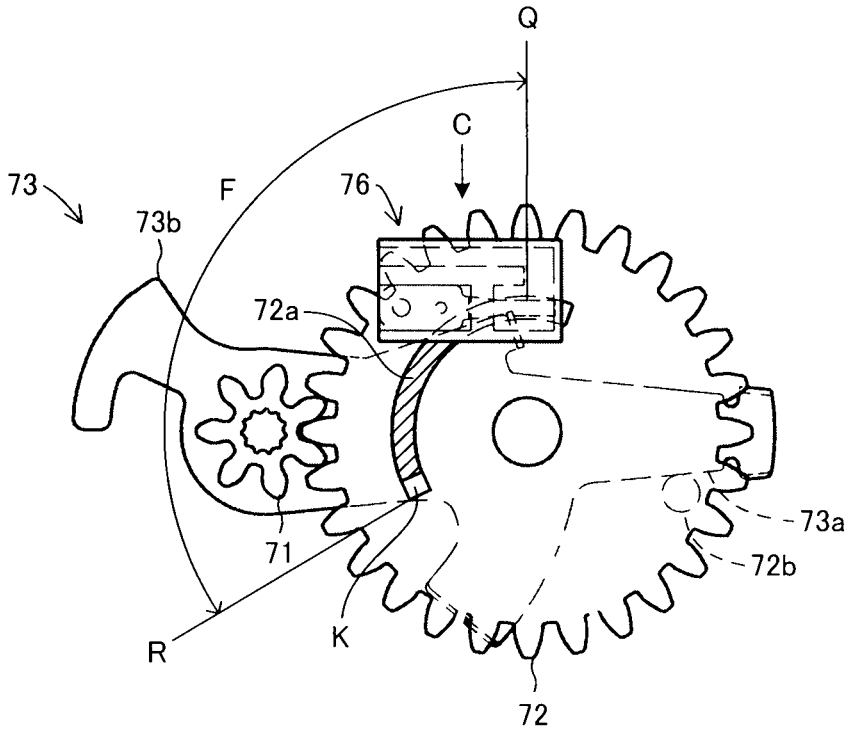
FIG. 20A is a front view illustrating an arrangement relationship between the cam and the reverse operation area detection switch at the time when the open/close position of the window glass is an insensitive area start position.
Figure 20B:
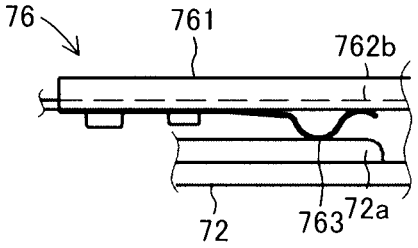
FIG. 20B is a view taken in the arrow C direction of FIG. 20A.

FIG. 20A is a front view illustrating an arrangement relationship between the rotational position of the cam 72*a* and the reverse operation area detection switch 76 at the time when the open/close position of the window glass W is the insensitive area start position. FIG. 20B is a view taken in the arrow C direction of FIG. 20A. As illustrated in FIGS. 20A and 20B, when the open/close position of the window glass W is the insensitive area start position, the movable piece 763 of the reverse operation area detection switch 76 is brought into contact with the cam 72*a*. Therefore, the tip end of the movable piece 763 is pressed by the cam 72*a* and is brought into contact with the second conductive portion 762*b*, with the result that the first conductive portion 762*a* and the second conductive portion 762*b* are brought into conduction. Accordingly, when the open/close position of the window glass W is the insensitive area start position, the switching state of the reverse operation area detection switch 76 is the ON state.

When the window glass W is closed in a range from the reverse operation area start position to the insensitive area start position, the end portion K of the cam 72*a* rotates from a rotational position indicated by the line Q of FIG. 20A to a rotational position indicated by the line R of FIG. 20A. Conversely, when the window glass W is opened in a range from the insensitive area start position to the reverse operation area start position, the end portion K rotates from the rotational position indicated by the line R of FIG. 20A to the rotational position indicated by the line Q of FIG. 20A. When the rotational position of the end portion K is situated within a rotational area F ranging from the rotational position indicated by the line Q of FIG. 20A to the rotational position indicated by the line R of FIG. 20A, the movable piece 763 of the reverse operation area detection switch 76 is brought into contact with the cam 72*a*. Thus, when the open/close position of the window glass W is situated within the area ranging from the reverse operation area start position to the insensitive area start position, that is, when the open/close position of the window glass W is situated within the reverse operation area, the switching state of the reverse operation area detection switch 76 is the ON state. Note that, when the window glass W is operated in the range from the insensitive area start position to the fully closed position as described above, the second gear 72 revolves about the first gear 71. Thus, in this period, the switching state of the reverse operation area detection switch 76 is the OFF state.

As can be seen from the above description, the window regulator device of this embodiment includes the object pinching detection switch 66, the insensitive area detection switch 75, and the reverse operation area detection switch 76. The object pinching detection switch 66 performs the switching operation based on whether or not the pinching is detected. The insensitive area detection switch 75 performs the switching operation based on whether or not the open/close position of the window glass W is situated within the insensitive area. The reverse operation area detection switch 76 performs the switching operation based on whether or not the open/close position of the window glass W is situated within the reverse operation area. Table 1 provides a summary of the conditions in which the switching states of the respective switches become the ON state, and the conditions in which the switching states of the respective switches become the OFF state.

TABLE 1

| | OFF state | ON state |
|---|---|---|
| Object pinching detection switch | Pinching is not detected | Pinching is detected |
| Insensitive area detection switch | Open/close position of window glass is situated within insensitive area | Open/close position of window glass is situated out of insensitive area |
| Reverse operation area detection switch | Open/close position of window glass is situated out of reverse operation area | Open/close position of window glass is situated within reverse operation area |

As shown in Table 1, when the pinching is detected and the open/close position of the window glass W is situated out of the insensitive area and within the reverse operation area (that is, the open/close position of the window glass W is situated within an area Q-R in FIG. 13), the switching states of all the switches are the ON state. When the switching states of all the switches are the ON state, anti-pinch processing is executed. The anti-pinch processing of this embodiment corresponds to reverse operation processing of reversing the operation of the window glass W from the closing operation to the opening operation.

According to the embodiment, the anti-pinch processing is not executed in a case where the open/close position of the window glass W is situated out of the reverse operation area, even when the pinching is detected and the open/close position of the window glass W is situated out of the insensitive area. The reason therefor is as follows.

In a case where the arm-type window regulator device is used as in this embodiment, as shown in the graph of FIG. 2, the moment acting on the output shaft changes depending on the rotational position of the lift arm. The largest moment acts on the output shaft particularly when the rotational position of the lift arm is the horizontal position in FIG. 1. When the moment acting on the output shaft is large, the pinching may be erroneously detected due to the moment. In order to prevent such erroneous detection, the anti-pinch processing needs to be inhibited when the moment acting on the output shaft is large. In this embodiment, such a rotational area of the lift arm that the moment acting on the output shaft becomes smaller is determined in advance, and an open/close area of the window glass corresponding to the determined rotational area is defined as the reverse operation area. The anti-pinch processing is permitted only when the open/close position of the window glass is situated within the reverse operation area. In this manner, the erroneous detection of the pinching due to the change in moment acting on the output shaft is prevented. Specifically, in the graph of FIG. 2, as the reverse operation area, there is defined an open/close area of the window glass W corresponding to a rotational area of the lift arm ranging from a reverse operation permission position, which is situated on the upper limit position side with respect to the horizontal position, to the upper limit position. Further, the cam 72*a* is formed on the second gear 72 so that, when the open/close position of the window glass W is situated within the reverse operation area, the switching state of the reverse operation area detection switch 76 becomes the ON state.

The anti-pinch processing may be executed based on an instruction signal from an ECU. In this case, the switches 66, 75, and 76 are connected to the ECU, and the ECU monitors the switching states of the respective switches. When the switching states of all the switches are the ON state, an instruction signal for executing the anti-pinch processing is output from the ECU to the electric motor. Accordingly, the anti-pinch processing is executed. However, the use of the ECU may lead to a problem of cost increase. In this respect, the window regulator device of this embodiment includes a drive circuit (electric circuit) in which an energization path from the electric power source to the electric motor 2 is formed so as to drive the electric motor 2. The respective switches are integrated into the drive circuit for energization of the electric motor 2, and a circuit structure of the drive circuit is devised in a predetermined manner. Accordingly, the anti-pinch processing is executed without using the ECU.

Figure 21:
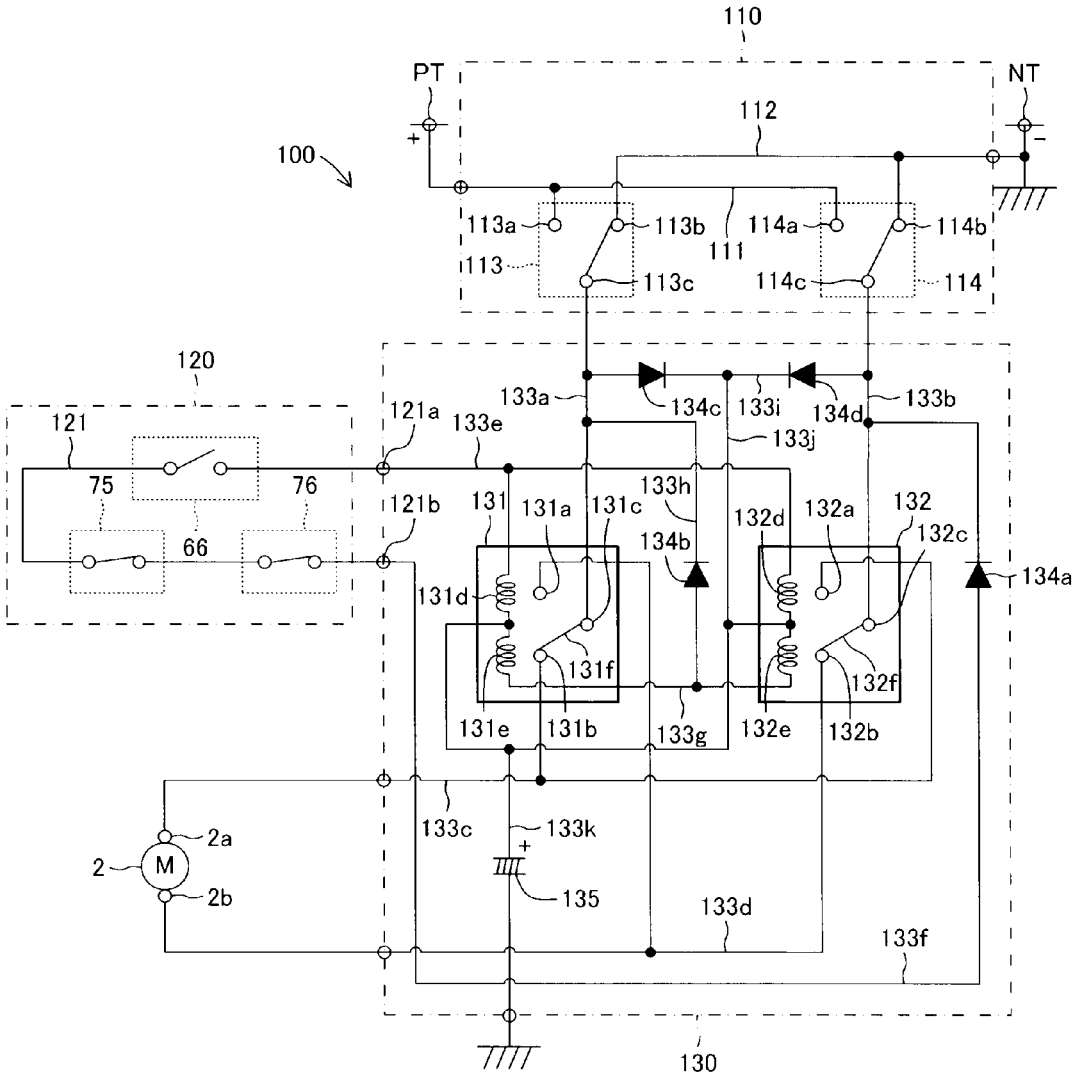
FIG. 21 is a circuit diagram illustrating a drive circuit for energizing an electric motor.

FIG. 21 is a circuit diagram illustrating the drive circuit for driving the electric motor 2. A drive circuit 100 illustrated in FIG. 21 mainly includes a power window switch circuit section 110, a detection switch circuit section 120, and a drive circuit section 130. The power window switch circuit section 110 includes a high voltage line 111 and a low voltage line 112, which serve as the energization path, and a first switch contact point 113 and a second switch contact point 114. The high voltage line 111 is connected to a positive terminal PT of the electric power source, and the low voltage line 112 is connected to a negative terminal NT of the electric power source. Note that, the electric power source is grounded on the negative terminal NT side to a vehicle body or the like.

The first switch contact point 113 and the second switch contact point 114 are two-input, one-output switch contact points including first input terminals 113*a* and 114*a*, second input terminals 113*b* and 114*b*, and single output terminals 113*c* and 114*c*, respectively. Those switch contact points each selectively switch a connection state between the input and output terminals in accordance with an operation position of an operation switch provided in a vehicle cabin, for opening and closing the window glass. Note that, the operation position of the operation switch is switchable among a neutral position, a window closing position, and a window opening position. When the operation switch is not operated, the operation position is the neutral position. When the window glass is closed, the operation switch is operated so that the operation position becomes the window closing position. When the window glass is opened, the operation switch is operated so that the operation position becomes the window opening position. Further, the high voltage line 111 is connected to the first input terminals 113*a* and 114*a*, and the low voltage line 112 is connected to the second input terminals 113*b* and 114*b*. When the operation switch is not operated, as illustrated in FIG. 21, the second input terminals 113*b* and 114*b* are connected to the output terminals 113*c* and 114*c*, respectively.

The detection switch circuit section 120 includes the object pinching detection switch 66, the insensitive area detection switch 75, the reverse operation area detection switch 76, and a switch line 121 serving as an energization path connecting those switches in series. When the switching states of all the switches are the ON state, one end 121*a* and another end 121*b* of the switch line 121 are brought into conduction.

The drive circuit section 130 includes a first latching relay 131 and a second latching relay 132. In this embodiment, those latching relays 131 and 132 are two-coil latching relays including first coils 131*d* and 132*d* and second coils 131*e* and 132*e*. In the first latching relay 131, when the first coil 131*d* is energized, a first terminal 131*a* and a third terminal 131*c* are brought into conduction, and when the second coil 131*e* is energized, a second terminal 131*b* and the third terminal 131*c* are brought into conduction. Similarly, in the second latching relay 132, when the first coil 132*d* is energized, a first terminal 132*a* and a third terminal 132*c* are brought into conduction, and when the second coil 132*e* is energized, a second terminal 132*b* and the third terminal 132*c* are brought into conduction. Hereinafter, the switching state in which the second terminal 131*b* and the third terminal 131*c* of the first latching relay 131 are held in conduction (state illustrated in FIG. 21) is referred to as a normal state, and the switching state in which the first terminal 131*a* and the third terminal 131*c* are held in conduction is referred to as a reverse state. Similarly, the switching state in which the second terminal 132*b* and the third terminal 132*c* of the second latching relay 132 are held in conduction (state illustrated in FIG. 21) is referred to as a normal state, and the switching state in which the first terminal 132*a* and the third terminal 131*c* are held in conduction is referred to as a reverse state. Further, the first coil 131*d* and the second coil 131*e* of the first latching relay 131 are connected in series. Similarly, the first coil 132*d* and the second coil 132*e* of the second latching relay 132 are connected in series.

Further, the drive circuit section 130 includes a first line 133*a*, a second line 133*b*, a third line 133*c*, and a fourth line 133*d* as electric power supply lines to the electric motor 2. The first line 133*a* electrically connects together the third terminal 131*c* of the first latching relay 131 and the output terminal 113*c* of the first switch contact point 113. The second line 133*b* electrically connects together the third terminal 132*c* of the second latching relay 132 and the output terminal 114*c* of the second switch contact point 114. The third line 133*c* is electrically connected at one end thereof to a first electric power supply terminal 2*a* that is one electric power supply terminal of the electric motor 2. The third line 133*c* is branched on another end side thereof into two lines. One of the branched lines is connected to the second terminal 131*b* of the first latching relay 131, and another of the branched lines is connected to the first terminal 132*a* of the second latching relay 132. The fourth line 133*d* is electrically connected at one end thereof to a second electric power supply terminal 2*b* that is another electric power supply terminal of the electric motor 2. The fourth line 133*d* is branched on another end side thereof into two lines. One of the branched lines is connected to the first terminal 131*a* of the first latching relay 131, and another of the branched lines is connected to the second terminal 132*b* of the second latching relay 132. Note that, in this embodiment, the electric motor 2 is rotatable in forward and reverse directions. When a current flows from the first electric power supply terminal 2*a* toward the second electric power supply terminal 2*b*, the electric motor 2 rotates in the forward direction, and when a current flows from the second electric power supply terminal 2*b* toward the first electric power supply terminal 2*a*, the electric motor 2 rotates in the reverse direction. When the electric motor 2 is driven to rotate in the forward direction, the window glass W is closed, and when the electric motor 2 is driven to rotate in the reverse direction, the window glass W is opened.

Further, the drive circuit section 130 includes a fifth line 133*e* and a sixth line 133*f*. The fifth line 133*e* is connected at one end thereof to the one end 121*a* of the switch line 121 of the detection switch circuit section 120. The fifth line 133*e* is branched on another end side thereof into two lines. One of the branched lines is connected to the first coil 131*d* of the first latching relay 131, and another of the branched lines is connected to the first coil 132*d* of the second latching relay 132. The sixth line 133*f* is connected at one end thereof to the another end 121*b* of the switch line 121. The sixth line 133*f* is connected at another end thereof to the second line 133*b*. A first diode 134*a* is mounted onto the sixth line 133*f*. The first diode 134*a* allows a current flowing from one end side of the sixth line 133*f* (side connected to the another end 121*b* of the switch line 121) toward another end side thereof (side connected to the second line 133*b*), and blocks a current flowing in a direction opposite thereto.

Further, the drive circuit section 130 includes a seventh line 133*g* and an eighth line 133*h*. The seventh line 133*g* connects together the second coil 131*e* of the first latching relay 131 and the second coil 132*e* of the second latching relay 132. The eighth line 133*h* is connected at one end thereof to the seventh line 133*g*, and is connected at another end thereof to the first line 133*a*. A second diode 134*b* is mounted onto the eighth line 133*h*. The second diode 134*b* allows a current flowing from one end side of the eighth line 133*h* (side connected to the seventh line 133*g*) toward another end side thereof (side connected to the first line 133*a*), and blocks a current flowing in a direction opposite thereto.

Further, the drive circuit section 130 includes a ninth line 133*i*, a tenth line 133*j*, and an eleventh line 133*k*. The ninth line 133*i* is connected at one end thereof to the first line 133*a*, and is connected at another end thereof to the second line 133*b*. In this embodiment, the ninth line 133*i* is connected on one end side thereof to a part of the first line 133*a* between a junction point to the output terminal 113*c* of the first switch contact point 113 and a junction point to the eighth line 133*h*. Further, the ninth line 133*i* is connected on another end side thereof to a part of the second line 133*b* between a junction point to the output terminal 114*c* of the second switch contact point 114 and a junction point to the sixth line 133*f*. The tenth line 133*j* is connected at one end thereof to the ninth line 133*i*. The tenth line 133*j* is branched on another end side thereof into two lines. One of the branched lines is connected to a lead wire by which the first coil 131*d* and the second coil 131*e* of the first latching relay 131 are connected in series, and another of the branched lines is connected to a lead wire by which the first coil 132*d* and the second coil 132*e* of the second latching relay 132 are connected in series.

A third diode 134*c* and a fourth diode 134*d* are mounted onto the ninth line 133*i*. The third diode 134*c* is provided between the one end of the ninth line 133*i* (end portion connected to the first line 133*a*) and the part of the ninth line 133*i* connected to the tenth line 133*j*, and the fourth diode 134*d* is provided between the another end of the ninth line 133*i* (end portion connected to the second line 133*b*) and the part of the ninth line 133*i* connected to the tenth line 133*j*. That is, the third diode 134*c* and the fourth diode 134*d* are provided while sandwiching a junction point between the ninth line 133*i* and the tenth line 133*j*. The third diode 134*c* allows a current flowing from the one end toward the another end of the ninth line 133*i*, and blocks a current flowing in a direction opposite thereto. On the other hand, the fourth diode 134*d* allows a current flowing from the another end toward the one end of the ninth line 133*i*, and blocks a current flowing in a direction opposite thereto.

The eleventh line 133*k* is connected at one end thereof to the tenth line 133*j*. The eleventh line 133*k* is grounded on another end side thereof to the vehicle body. A capacitor 135 is mounted onto the eleventh line 133*k*.

In such a circuit structure, when the operation switch is not operated (when the operation position is the neutral state), as described above, the second input terminal 113*b* of the first switch contact point 113 is connected to the output terminal 113*c*, and the second input terminal 114*b* of the second switch contact point 114 is connected to the output terminal 114*c*. When the connection is achieved in this manner, the high voltage line 111 connected to the first input terminals 113*a* and 114*a* is disconnected from the electric motor 2, and hence the electric power is not supplied from the positive terminal PT side of the electric power source to the electric motor 2. Therefore, the window glass W is not opened or closed.

Figure 22:
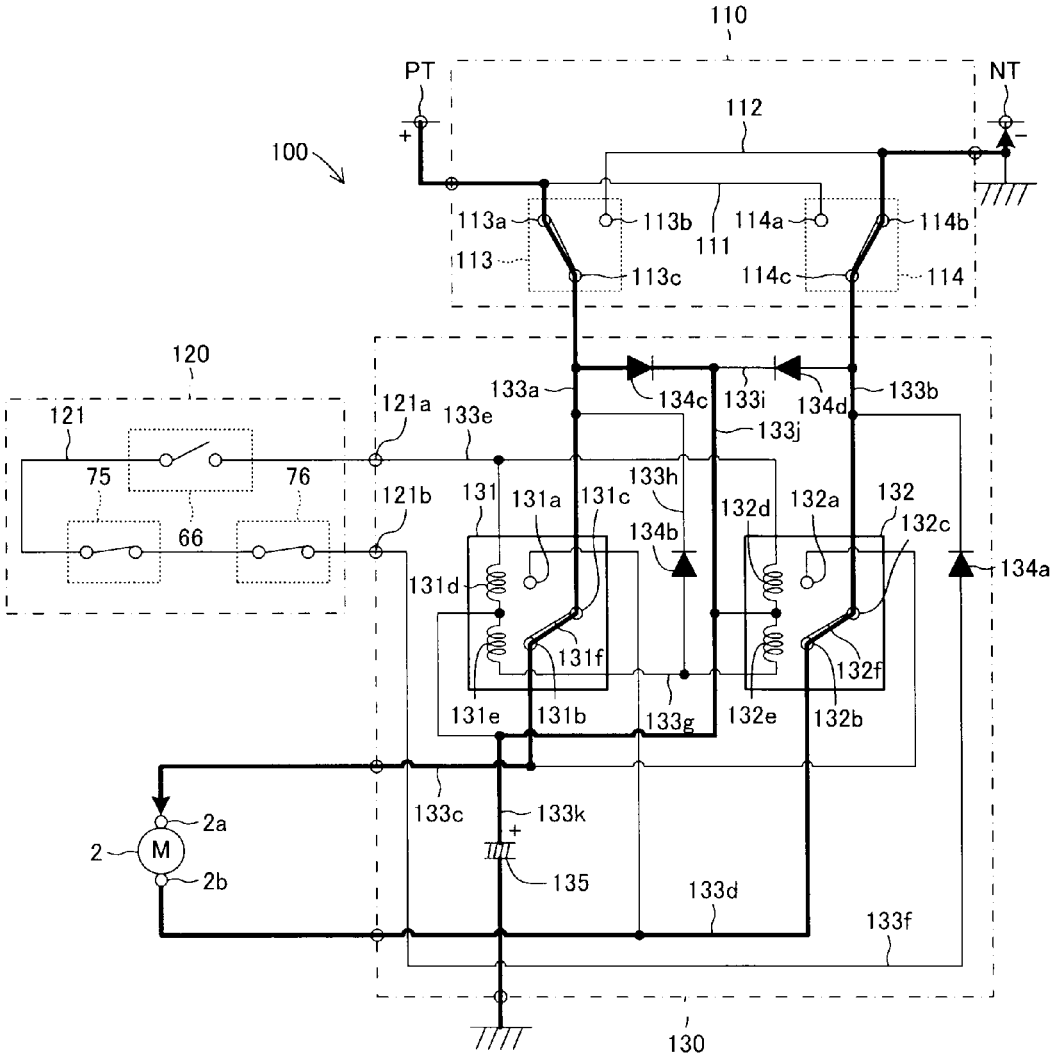
FIG. 22 is a circuit diagram of the drive circuit, illustrating an electric power supply path to the electric motor in a case where an operation switch is operated so that a window is closed.

Further, when the operation switch is operated so that the window glass W is closed (when the operation position is the window closing position) at the time when the foreign object is not pinched between the window glass W and the window frame, as illustrated in FIG. 22, the first input terminal 113*a* and the output terminal 113*c* of the first switch contact point 113 are connected to each other, and the second input terminal 114*b* and the output terminal 114*c* of the second switch contact point 114 are connected to each other. Accordingly, the high voltage line 111 is connected to the first line 133*a* via the first switch contact point 113. At this time, the switching state of the first latching relay 131 is the normal state (state in which the second terminal 131*b* and the third terminal 131*c* are brought into conduction). Therefore, the first line 133*a* and the third line 133*c* are connected to each other via the first latching relay 131. Thus, the positive terminal PT of the electric power source is electrically connected to the first electric power supply terminal 2*a* of the electric motor 2 via the high voltage line 111, the first switch contact point 113, the first line 133*a*, the first latching relay 131, and the third line 133*c*.

Further, the low voltage line 112 is connected to the second line 133*b* via the second switch contact point 114. Further, at this time, the switching state of the second latching relay 132 is the normal state (state in which the second terminal 132*b* and the third terminal 132*c* are brought into conduction), and hence the second line 133*b* and the fourth line 133*d* are connected to each other via the second latching relay 132. Thus, the negative terminal NT of the electric power source is electrically connected to the second electric power supply terminal 2*b* of the electric motor 2 via the low voltage line 112, the second switch contact point 114, the second line 133*b*, the second latching relay 132, and the fourth line 133*d*.

Therefore, an electric power supply path as indicated by the thick line in FIG. 22 is formed, and the electric power is supplied from the electric power source to the electric motor 2. At this time, a current flows from the first electric power supply terminal 2*a* to the second electric power supply terminal 2*b* of the electric motor 2. When a current flows in this direction, the electric motor 2 rotates in the forward direction. Through the forward rotation of the electric motor 2, the window glass W is closed. Further, a current flowing through the first line 133*a* from the high voltage line 111 via the first switch contact point 113 is split into the ninth line 133*i* side, and further flows through the tenth line 133*j* and the eleventh line 133*k*. Due to the current flowing through the eleventh line 133*k*, the capacitor 135 mounted onto the eleventh line 133*k* is charged.

Figure 23:
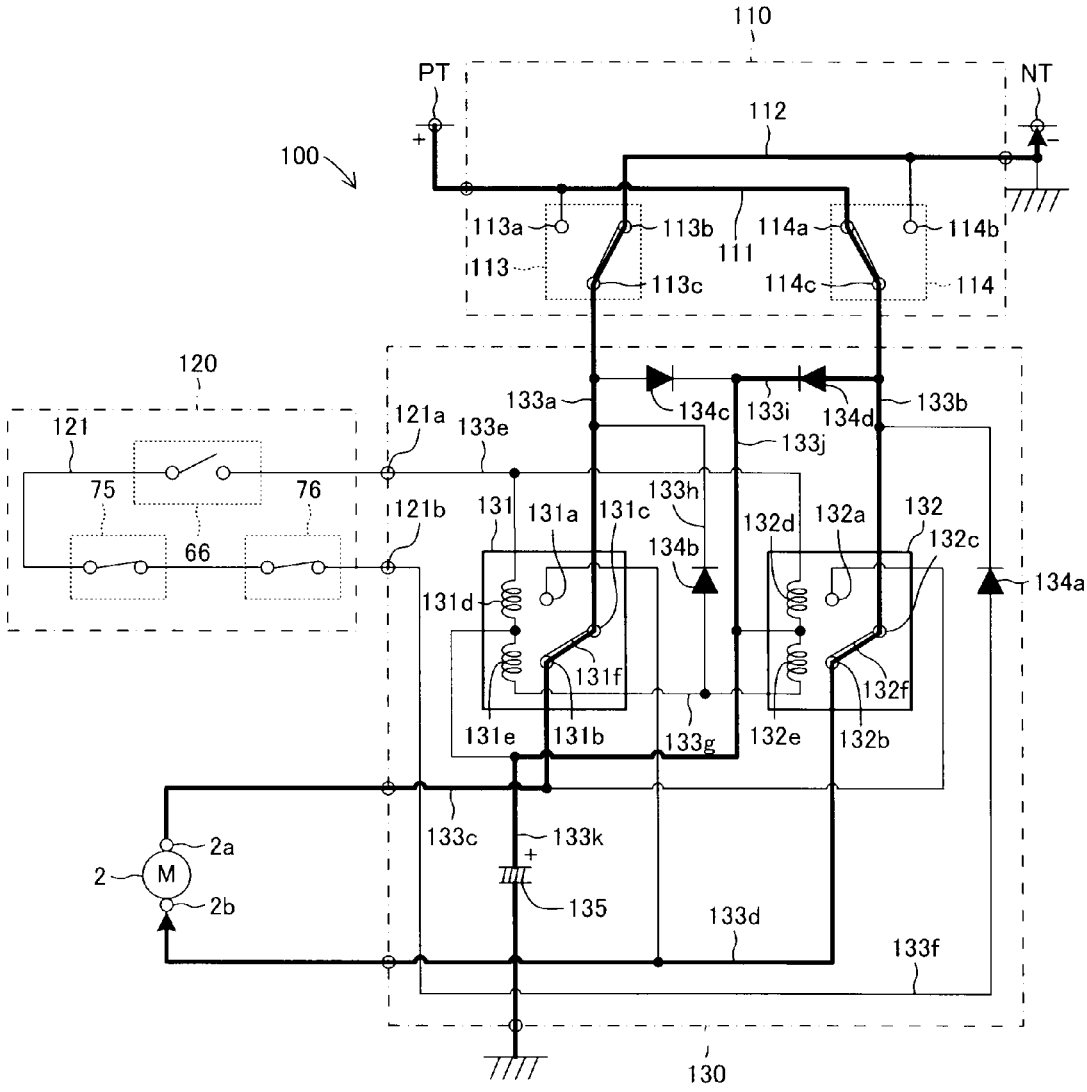
FIG. 23 is a circuit diagram of the drive circuit, illustrating an electric power supply path to the electric motor in a case where the operation switch is operated so that the window is opened.

When the operation switch is operated so that the window glass W is opened (when the operation position is the window opening position), as illustrated in FIG. 23, the second input terminal 113*b* and the output terminal 113*c* of the first switch contact point 113 are connected to each other, and the first input terminal 114*a* and the output terminal 114*c* of the second switch contact point 114 are connected to each other. Accordingly, the high voltage line 111 is connected to the second line 133*b* via the second switch contact point 114. The switching state of the second latching relay 132 is the normal state, and hence the second line 133*b* and the fourth line 133*d* are connected to each other via the second latching relay 132. Thus, the positive terminal PT of the electric power source is electrically connected to the second electric power supply terminal 2*b* of the electric motor 2 via the high voltage line 111, the second switch contact point 114, the second line 133*b*, the second latching relay 132, and the fourth line 133*d*.

Further, the low voltage line 112 is connected to the first line 133*a* via the first switch contact point 113. At this time, the switching state of the first latching relay 131 is the normal state, and hence the first line 133*a* and the third line 133*c* are connected to each other via the first latching relay 131. Thus, the negative terminal NT of the electric power source is electrically connected to the first electric power supply terminal 2*a* of the electric motor 2 via the low voltage line 112, the first switch contact point 113, the first line 133*a*, the first latching relay 131, and the third line 133*c*.

Therefore, an electric power supply path as indicated by the thick line in FIG. 23 is formed, and the electric power is supplied from the electric power source to the electric motor 2. At this time, as illustrated in FIG. 23, a current flows from the second electric power supply terminal 2*b* toward the first electric power supply terminal 2*a* of the electric motor 2. When a current flows in this direction, the electric motor 2 rotates in the reverse direction. Through the reverse rotation of the electric motor 2, the window glass W is opened. Further, a current flowing through the second line 133*b* from the high voltage line 111 via the second switch contact point 114 is split into the ninth line 133*i* side, and further flows through the tenth line 133*j* and the eleventh line 133*k*. Due to the current flowing through the eleventh line 133*k*, the capacitor 135 is charged.

Figure 24:
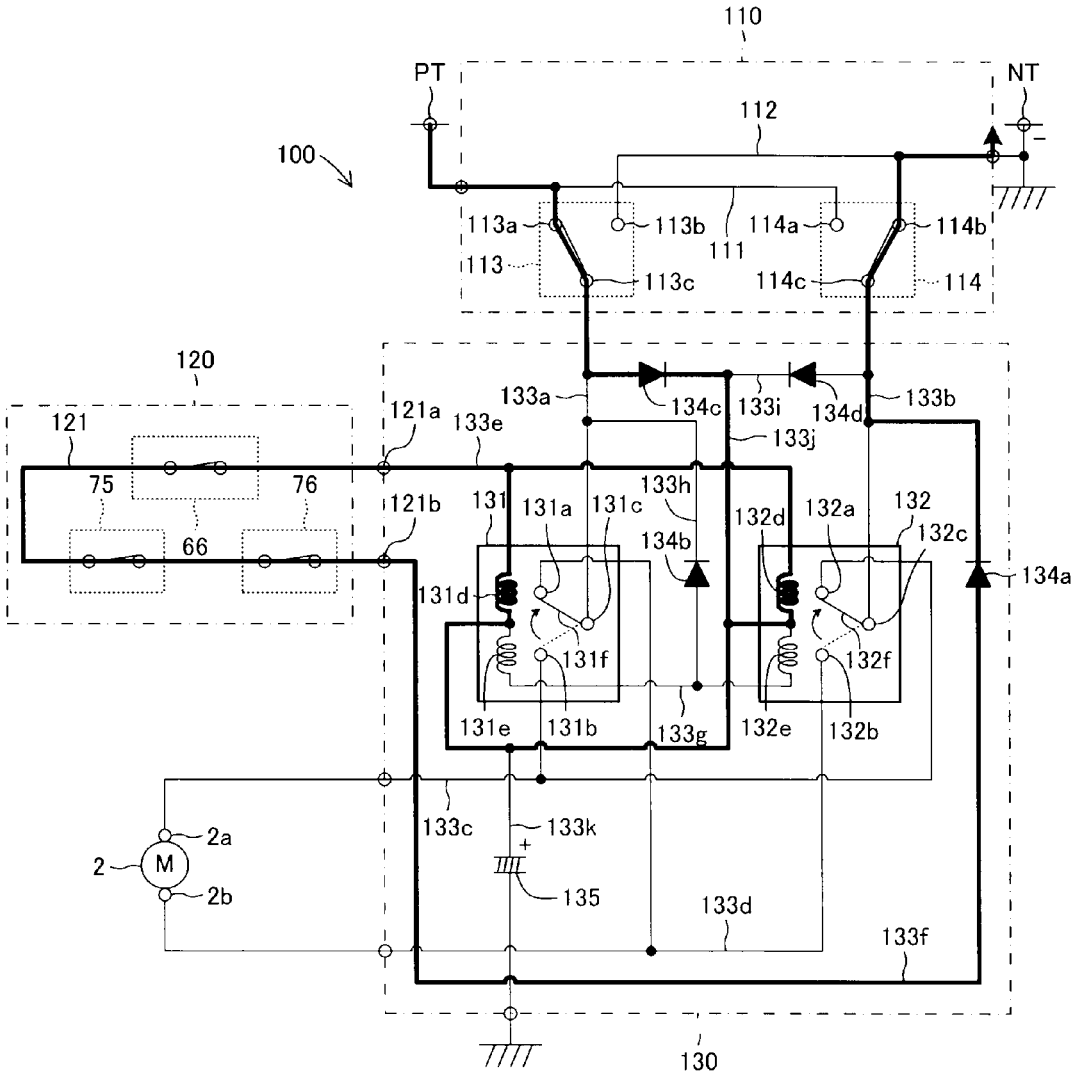
FIG. 24 is a circuit diagram of the drive circuit, illustrating an energization path for switching between a first latching relay and a second latching relay at the time of object pinching detection.

When the pinching of the foreign object is detected at the time of the closing operation of the window glass W (when the operation position of the operation switch is the window closing position), the switching state of the object pinching detection switch 66 becomes the ON state. At this time, when the switching state of the insensitive area detection switch 75 is the ON state and the switching state of the reverse operation area detection switch 76 is also the ON state, both the ends 121*a* and 121*b* of the switch line 121 of the detection switch circuit section 120 are brought into conduction. Accordingly, as illustrated in FIG. 24, a current flows through a relay circuit connecting the high voltage line 111, the first switch contact point 113, the first line 133*a*, the ninth line 133*i*, the tenth line 133*j*, the first coil 131*d* of the first latching relay 131 and the first coil 132*d* of the second latching relay 132, the fifth line 133*e*, the switch line 121, the sixth line 133*f*, the second line 133*b*, the second switch contact point 114, and the low voltage line 112. Accordingly, the first coil 131*d* of the first latching relay 131 and the first coil 132*d* of the second latching relay 132, which are provided between the tenth line 133*j* and the fifth line 133*e*, are energized. Through the energization of the first coil 131*d* of the first latching relay 131, a movable piece 131*f* is operated so that the first terminal 131*a* and the third terminal 131*c* are connected to each other. Through the energization of the first coil 132*d* of the second latching relay 132, a movable piece 132*f* is operated so that the first terminal 132*a* and the third terminal 132*c* are connected to each other. In this manner, the switching states of the first and second latching relays 131 and 132 are switched from the normal state to the reverse state.

Figure 25:
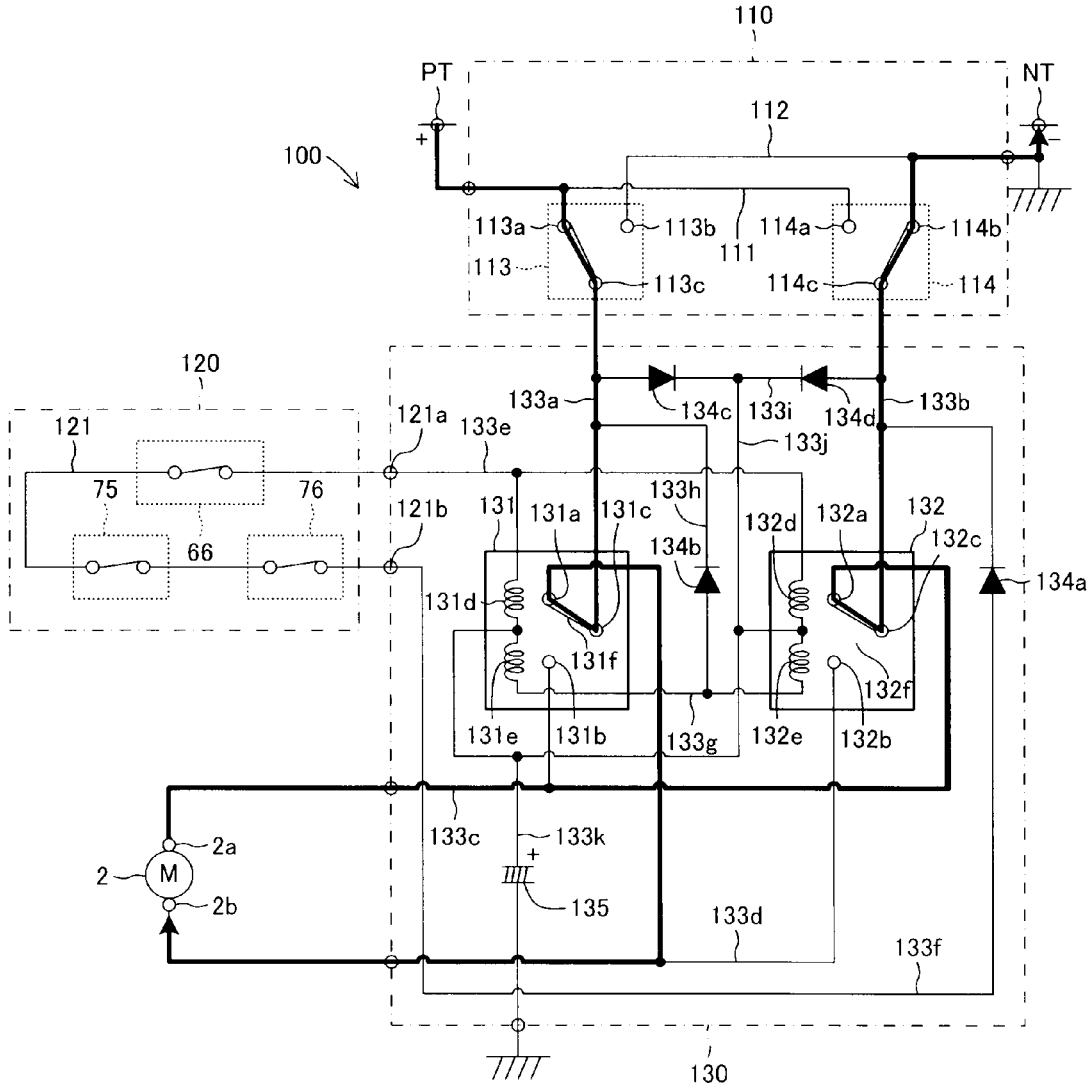
FIG. 25 is a circuit diagram of the drive circuit, illustrating an electric power supply path to the electric motor at the time of anti-pinch processing.

Through the above-mentioned switching operation of the latching relays, the electric power supply path from the electric power source to the electric motor 2 changes from the path of FIG. 22 to the path of FIG. 25. As illustrated in FIG. 25, the positive terminal PT of the electric power source is connected to the second electric power supply terminal 2*b* of the electric motor 2 via the high voltage line 111, the first switch contact point 113, the first line 133*a*, the first latching relay 131, and the fourth line 133*d*. Further, the negative terminal NT of the electric power source is connected to the first electric power supply terminal 2*a* of the electric motor 2 via the low voltage line 112, the second switch contact point 114, the second line 133*b*, the second latching relay 132, and the third line 133*c*. Therefore, the direction of the electric power supply to the electric motor 2 is reversed, and the electric motor 2 rotates in the reverse direction. Through the reverse rotation of the electric motor 2, the window glass W is reversely operated. That is, when the pinching is detected, the window glass W is opened even in a case where the operation switch is operated so that the window is closed.

Figure 26:
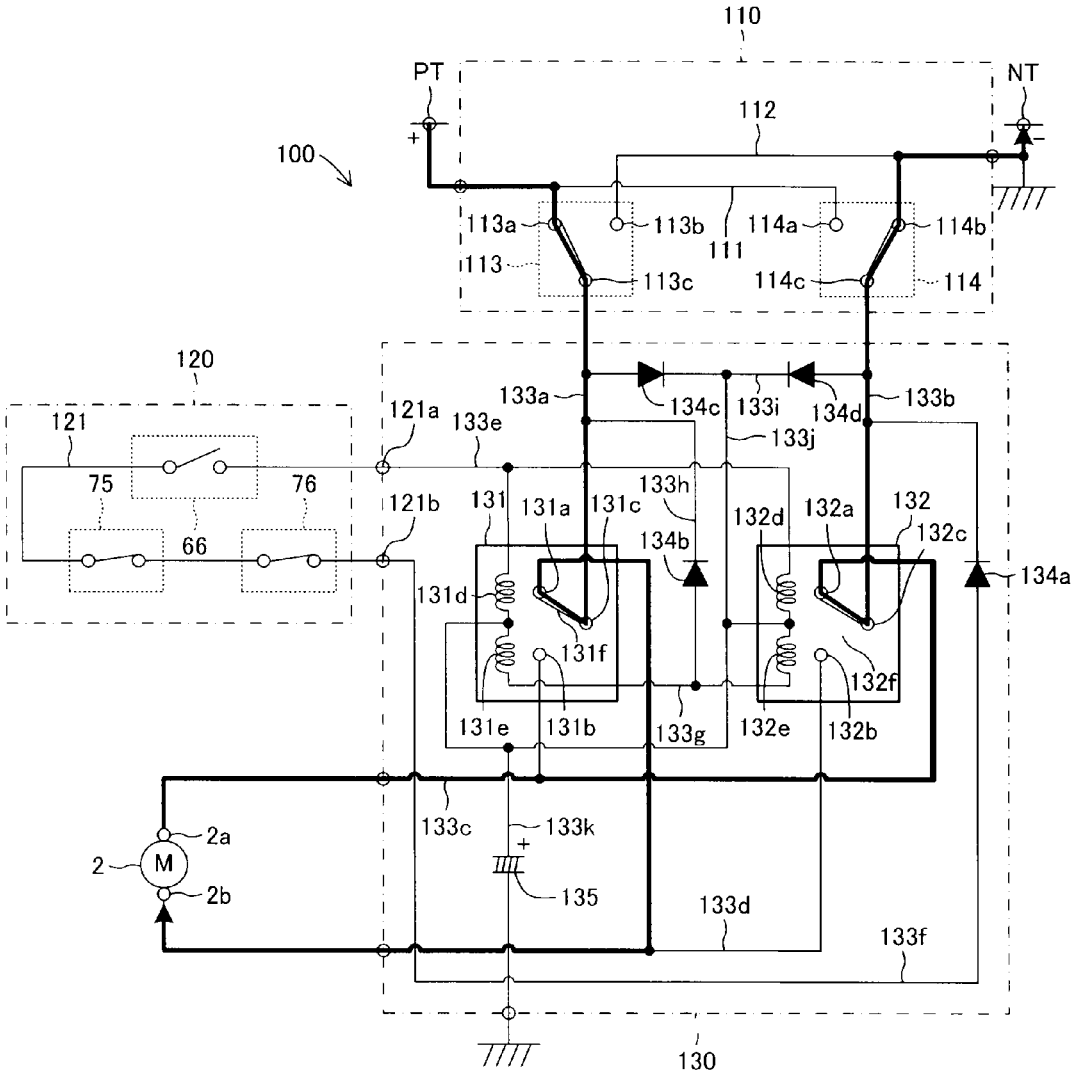
FIG. 26 is a circuit diagram of the drive circuit, illustrating the electric power supply path to the electric motor at the time of anti-pinch processing.

When the window glass W is opened as described above in response to the detection of the pinching, the pinching state is eliminated, and hence the switching state of the object pinching detection switch 66 becomes the OFF state again. Then, the energization path indicated by the thick line in FIG. 24 is not formed, but due to magnetic forces of permanent magnets or the like, the first and second latching relays 131 and 132 maintain the connection between the first terminal 131*a* and the third terminal 131*c* and the connection between the first terminal 132*a* and the third terminal 132*c*, respectively, also after the energization of the coils is finished. Thus, even after the switching state of the object pinching detection switch 66 becomes the OFF state, as long as the operation switch is operated so that the window is closed, the electric power supply path to the electric motor 2 does not change as illustrated in FIG. 26. Thus, the reverse operation (opening operation) of the window glass W is continued.

Figure 27:
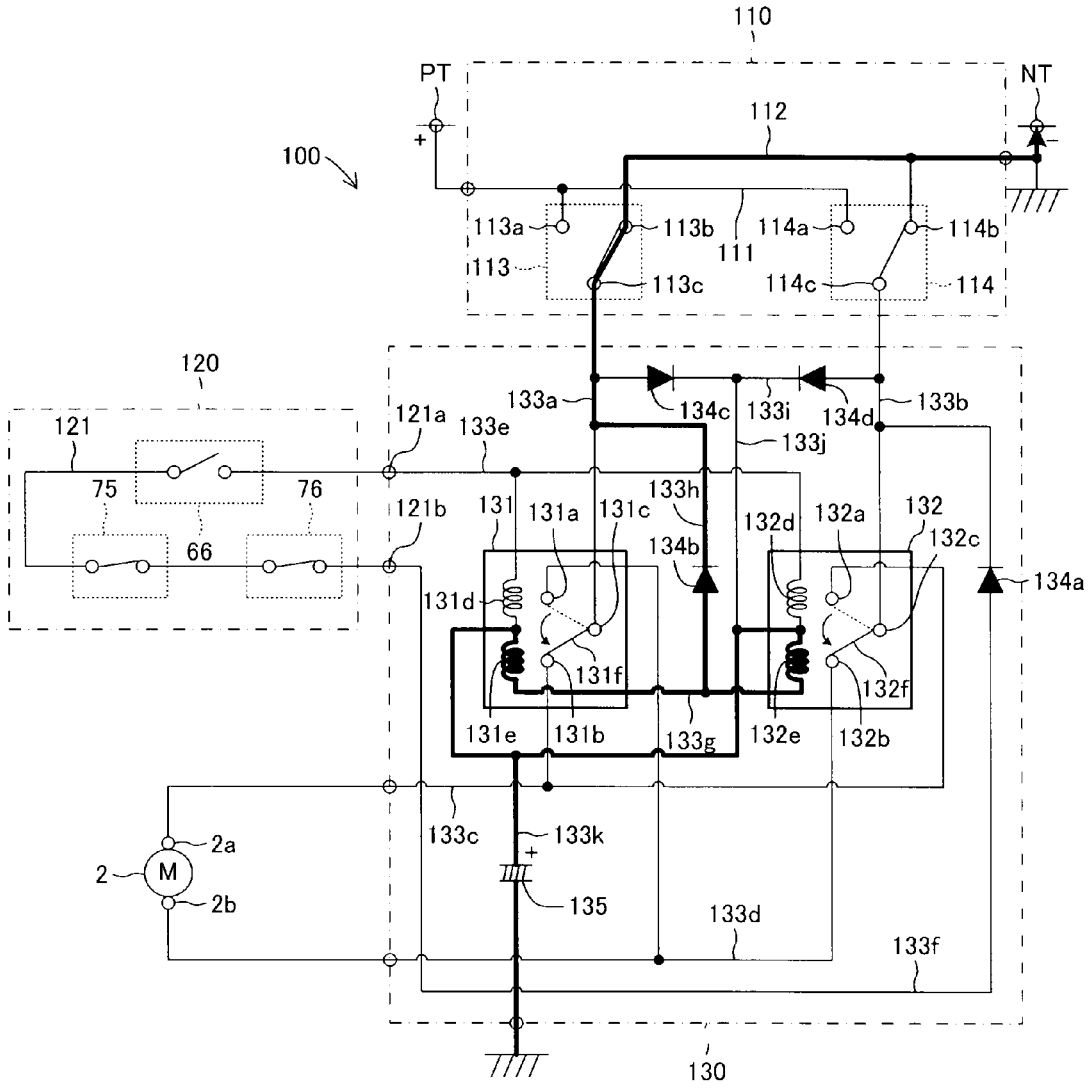
FIG. 27 is a circuit diagram of the drive circuit, illustrating a path for discharging electricity accumulated in the capacitor.

After that, when the operation of the operation switch is stopped and the operation position returns to the neutral position, as illustrated in FIG. 27, the second input terminal 113*b* of the first switch contact point 113 is connected to the output terminal 113*c*, and the second input terminal 114*b* of the second switch contact point 114 is connected to the output terminal 114*c*. Accordingly, the positive terminal PT of the electric power source and the electric motor 2 are electrically disconnected so that the reverse operation (opening operation) of the window glass W is stopped. At this time, as indicated by the thick line in FIG. 27, a discharge current of the capacitor 135 flows through a relay circuit connecting the eleventh line 133*k*, the tenth line 133*j*, the second coil 131*e* of the first latching relay 131 and the second coil 132*e* of the second latching relay 132, the seventh line 133*g*, the eighth line 133*h*, the first line 133*a*, and the low voltage line 112. Therefore, the second coil 131*e* of the first latching relay 131 and the second coil 132*e* of the second latching relay 132, which are provided between the tenth line 133*j* and the seventh line 133*g*, are energized. Through the energization of the second coil 131*e* of the first latching relay 131, the movable piece 131*f* is operated so that the second terminal 131*b* and the third terminal 131*c* are connected to each other. Through the energization of the second coil 132*e* of the second latching relay 132, the movable piece 132*f* is operated so that the second terminal 132*b* and the third terminal 132*c* are connected to each other. In this manner, when the operation of the operation switch is stopped after the reverse operation, the switching states of both the latching relays are switched from the reverse state to the normal state. This switching state is maintained until the reverse operation is performed subsequently (that is, until the switching states of all the switches 66, 75, and 76 become the ON state subsequently).

After that, when the operation switch is operated so that the operation position of the operation switch becomes the window opening position, a current flows through the path illustrated in FIG. 23, and accordingly the window glass W is opened. When the operation switch is operated so that the operation position of the operation switch becomes the window closing position, a current flows through the path illustrated in FIG. 22, and accordingly the window glass W is closed. As described above, in this embodiment, without using the ECU, the window glass W is automatically opened and closed, and the window glass W is automatically reversely operated when the pinching is detected.

As described above, the window regulator device of the present embodiment includes the electric motor 2 serving as the power source, the output shaft 3 connected to the electric motor 2 and rotatable by the rotational drive force that is generated by the electric motor 2, the drive force transmission mechanism 9 for transmitting the rotational drive force of the output shaft 3 to the window glass W of the vehicle so as to open and close the window glass W by the rotational drive force of the output shaft 3, and the position detection unit 7 for detecting whether or not the open/close position of the window glass W is situated within the insensitive area that is set in advance. Further, the position detection unit 7 includes the first gear 71 and the second gear 72 serving as a rotational member rotatable by the rotational drive force of the output shaft 3, the operation lever 73, and the insensitive area detection switch 75 for performing the switching operation based on the rotational operation of the operation lever 73. Further, the operation lever 73 is configured to avoid engaging with the second gear 72 when the open/close position of the window glass W is situated out of the insensitive area, and engage with the second gear 72 when the open/close position of the window glass W is situated within the insensitive area. Further, the operation lever 73 is rotated as illustrated in FIG. 16 by the rotational drive force of the output shaft 3 transmitted via the second gear 72 when the operation lever 73 engages with the second gear 72.

According to this embodiment, the operation lever 73 is used as a detection member for changing the switching state of the insensitive area detection switch 75. The operation lever 73 is provided separately from the rotational member (first gear 71 and second gear 72), and hence an operation stroke thereof can be increased irrespective of the size of the rotational member. The operation stroke can be increased, and hence, even when a certain amount of displacement has occurred in the arrangement of the operation lever 73 and the insensitive area detection switch 75, a detection error of the insensitive area based on the displacement can be reduced. Thus, even if the shape of the operation lever 73, the arrangement relationship between the operation lever 73 and the insensitive area detection switch 75, and the like are not strictly managed, the deterioration in detection accuracy can be suppressed sufficiently.

Further, the rotational member rotatable by the rotational drive force of the output shaft 3 includes the first gear 71 supported by the output shaft 3 so as to be rotatable integrally therewith, and the second gear 72 meshing with the first gear 71 and configured to reduce the rotation speed of the first gear 71, the second gear 72 including the projecting portion 72*b* formed so as to be engageable with the operation lever 73. Further, the projecting portion 72*b* is arranged and formed on the second gear 72 so as to avoid engaging with the operation lever 73 when the open/close position of the window glass W is situated out of the insensitive area, and engage with the operation lever 73 when the open/close position of the window glass W is situated within the insensitive area. Further, the operation lever 73 is rotated by the rotational drive force of the output shaft 3 transmitted via the second gear 72 when the operation lever 73 engages with the projecting portion 72*b*. With this structure, when the second gear 72 and the operation lever 73 engage with each other, the rotational drive force of the output shaft 3 is reliably transmitted to the operation lever 73 via the projecting portion 72*b*, the second gear 72, and the first gear 71.

Further, the operation lever 73 is supported by the output shaft 3 so as to be relatively rotatable, and is coupled to the second gear 72 via the coupling pin 77 for rotatably supporting the second gear 72. Therefore, when the projecting portion 72*b* formed on the second gear 72 engages with the operation lever 73, through the engagement, the rotation of the second gear 72 is hindered and the operation lever 73 and the second gear 72 are integrally operable. At the time of the engagement, the second gear 72 revolves about the first gear 71 in the same direction as the rotational direction of the first gear 71 due to the mesh with the first gear 71. Along with the revolution of the second gear 72, the operation lever 73 coupled to the second gear 72 via the coupling pin 77 is rotated about the output shaft 3 (first gear) in the same direction as the rotational direction of the first gear 71. As described above, the rotation of the second gear 72 is regulated through the engagement between the operation lever 73 and the second gear 72, and the operation lever 73 is rotated along with the revolution of the second gear 72 by the rotational force of the first gear 71, with the result that the operation lever 73 is rotated more reliably.

Further, the position detection unit 7 includes the retention spring 74 for biasing the operation lever 73 in the direction (X' direction) opposite to the direction in which the output shaft 3 rotates at the time of the closing operation of the window glass W (X direction), and the stopper 73*g* for regulating the rotation of the operation lever 73 that is caused by the biasing force of the retention spring 74 to align the rotational position of the operation lever 73. Therefore, when the projecting portion 72*b* does not engage with the operation lever 73, the operation lever 73 is reliably aligned at a desired position.

(Second Embodiment)

Next, a second embodiment of the present invention is described. A window regulator device of this embodiment has substantially the same structure as described in the above-mentioned first embodiment except for the position detection unit. Thus, reference is made to the first embodiment for the same components as those in the first embodiment to omit description thereof, and components different from those in the first embodiment are mainly described below.

As described in the above-mentioned first embodiment with reference to FIG. 1, the window regulator device according to this embodiment also includes a drive mechanism 1 and a drive force transmission mechanism 9. The drive force transmission mechanism 9 has the same structure as described in the above-mentioned first embodiment, and description thereof is therefore omitted herein.

Figure 28:
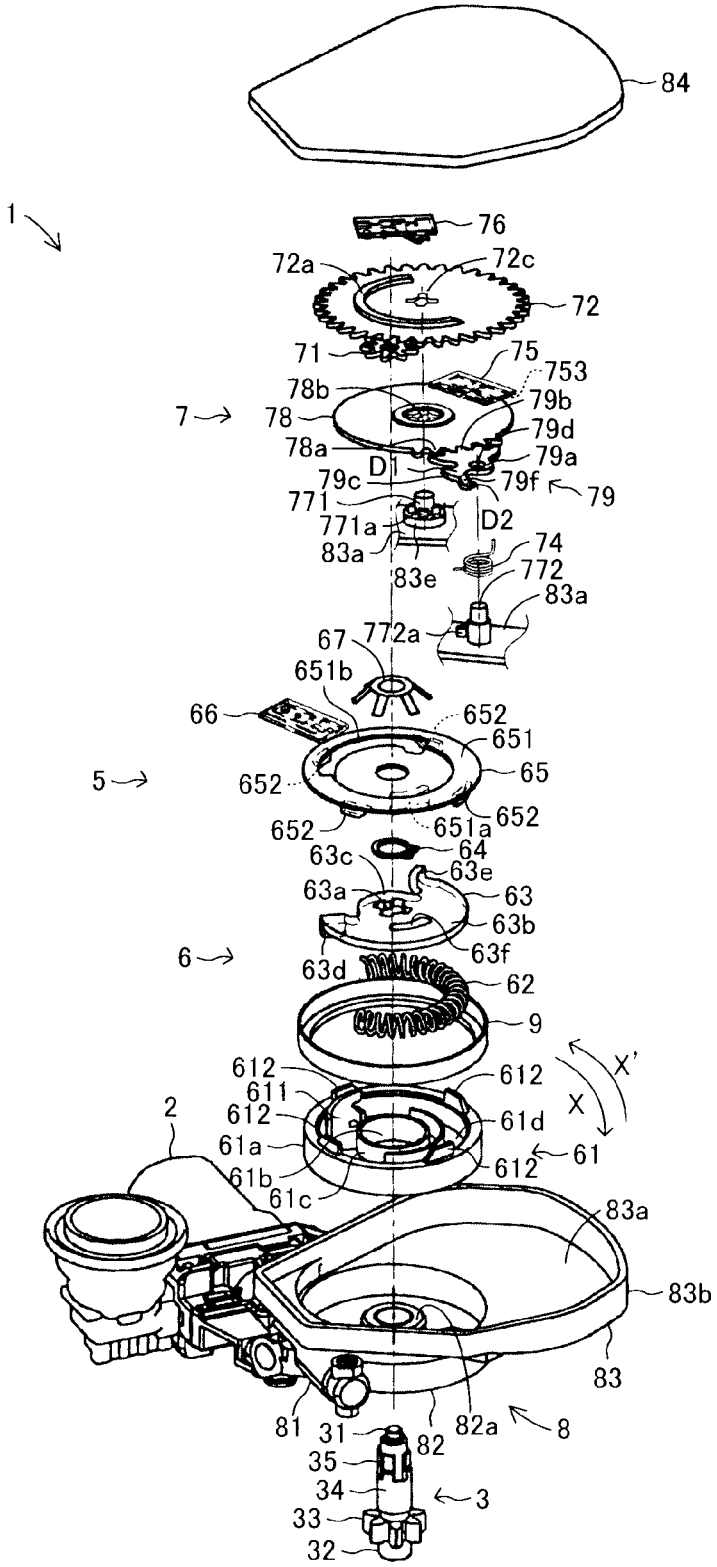
FIG. 28 is an exploded perspective view of a drive mechanism of a window regulator device according to a second embodiment of the present invention.

FIG. 28 is an exploded perspective view of the drive mechanism 1 according to this embodiment. The drive mechanism 1 includes an electric motor 2, an output shaft 3, a detection unit 5, and a housing 8. The electric motor 2 and the output shaft 3 each have the same structure as in the above-mentioned first embodiment, and description thereof is therefore omitted herein. The housing 8 coupled to the electric motor 2 includes, similarly to the above-mentioned first embodiment, a first housing portion 81, a second housing portion 82, a third housing portion 83, and a lid 84. The first housing portion 81 and the second housing portion 82 each have a structure similar to that in the above-mentioned first embodiment. The third housing portion 83 has the same outer shape as the third housing portion described in the first embodiment. Further, a first support pin 771 and a second support pin 772 are provided on a bottom surface 83*a* of the third housing portion 83 according to this embodiment. The first support pin 771 is axially supported by a boss portion 83*e* formed on the bottom surface 83*a* so as to be relatively rotatable, and the first support pin 771 extends upward in FIG. 28. A fitting portion 771*a* having a cross shape in cross-section is formed at a base end part of the first support pin 771. The second support pin 772 is fixed to the bottom surface 83*a* of the third housing portion 83. A stopper 772*a* is formed at a base end part of the second support pin 772. The first support pin 771 and the second support pin 772 are rotatably supported at tip ends thereof by the lid 84.

The detection unit 5 includes an object pinching detection unit 6 and a position detection unit 7. The object pinching detection unit 6 has the same structure as described in the above-mentioned first embodiment, and description thereof is therefore omitted herein. The position detection unit 7 includes a first gear 71, a second gear 72, a lever drive gear 78, an operation lever 79, a retention spring 74, an insensitive area detection switch 75, a reverse operation area detection switch 76, and the above-mentioned first support pin 771 and second support pin 772 provided on the third housing portion 83. A circular hole is formed at the center of the first gear 71. The output shaft 3 is inserted through the circular hole, and accordingly the first gear 71 is supported by the output shaft 3 so as to be rotatable integrally therewith. The second gear 72 meshes with the first gear 71. The number of teeth of the second gear 72 is larger than the number of teeth of the first gear 71. Thus, the second gear 72 reduces the rotation speed of the first gear 71. Further, a cam 72*a* having a projecting shape is formed on an upper surface of the second gear 72 in FIG. 28. The cam 72*a* is formed into an arc shape with a predetermined length along a circumferential direction of the second gear 72. Further, a through-hole 72*c* having a cross shape in cross-section is formed at the center of the second gear 72. The lever drive gear 78 is disposed below the second gear 72 in FIG. 28. A tooth portion 78*a* is formed at a part of an outer periphery of the lever drive gear 78. A through-hole 78*b* having a cross shape in cross-section is formed at the center of the lever drive gear 78.

The fitting portion 771*a* of the first coupling pin 771 is fitted into the through-hole 72*c* having a cross shape and formed in the second gear 72 and the through-hole 78*b* having a cross shape and formed in the lever drive gear 78. Accordingly, the second gear 72 and the lever drive gear 78 are supported by the first coupling pin 771 so as to be integrally rotatable.

The operation lever 79 is formed into a plate shape, and includes a base portion 79*a*, a gear portion 79*b* formed into a fan shape about the base portion 79*a* and having teeth formed on an outer periphery thereof, and a lever portion 79*c* formed into a hook shape and extending from the base portion 79*a*. A circular hole 79*d* is formed in the base portion 79*a*. The operation lever 79 is disposed at such a position that the gear portion 79*b* thereof is meshable with the tooth portion 78*a* formed on the outer periphery of the lever drive gear 78. The second support pin 772 is inserted through the circular hole 79*d* so that the operation lever 79 is rotatably supported by the second support pin 772. Note that, the retention spring 74 is mounted onto the second support pin 772. The retention spring 74 engages at one end thereof with the stopper 772*a* formed on the second support pin 772, and engages at another end thereof with the operation lever 79 mounted onto the second support pin 772. The position of the operation lever 79 is regulated by an elastic force of the retention spring 74.

Figure 29:
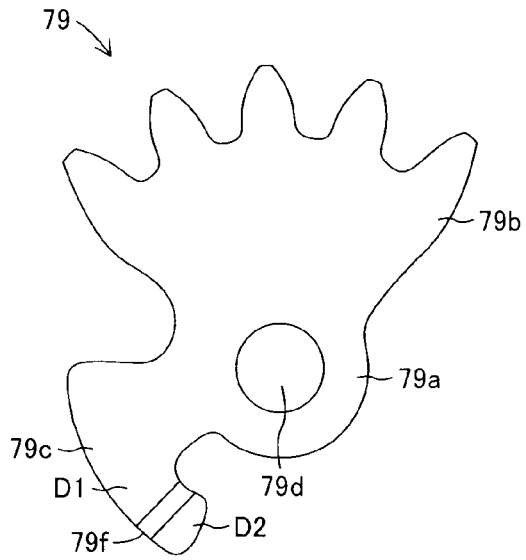
FIG. 29 is a front view of an operation lever according to the second embodiment.

FIG. 29 is a front view of the operation lever 79. As can be seen from FIG. 29, a step 79*f* is formed in the lever portion 79*c*. When an axial direction of the circular hole 79*d* is defined as a height direction, the position of one part D1 in the height direction and the position of another part D2 in the height direction, which sandwich the step 79*f*, are different from each other.

The insensitive area detection switch 75 and the reverse operation area detection switch 76 have the same structures as the insensitive area detection switch 75 and the reverse operation area detection switch 76 described in the above-mentioned first embodiment with reference to FIGS. 8 and 9, respectively. Thus, reference is made to FIGS. 8 and 9, and description thereof is therefore omitted herein.

The insensitive area detection switch 75 is fixed at such a position that, when the operation lever 79 rotates about the second support pin 772, the tip end portion of the movable piece 753 climbs over the step 79*f* formed in the lever portion 79*c* of the operation lever 79. When the operation lever 79 is viewed from the insensitive area detection switch 75 fixed at such a position, of the one part D1 and the another part D2 sandwiching the step 79*f* of the lever portion 79*c* of the operation lever 79, the one part D1 is closer to the insensitive area detection switch 75 as compared to the another part D2. That is, the height position of the part D1 is higher than the height position of the part D2. When the tip end part of the movable piece 753 is held in contact with the part D1, the movable piece 753 is pressed and the tip end portion thereof is brought into contact with the second conductive portion 752*b* on the substrate 751, with the result that the switching state of the insensitive area detection switch 75 becomes the ON state. On the other hand, when the tip end portion of the movable piece 753 is held in contact with the part D2, the tip end portion of the movable piece 753 is spaced apart from the second conductive portion 752*b* on the substrate 751, with the result that the switching state of the insensitive area detection switch 75 becomes the OFF state. Note that, an arrangement relationship between the reverse operation area detection switch 76 and the second gear 72 is the same as the arrangement relationship described in the above-mentioned first embodiment, and description thereof is therefore omitted herein.

In the window regulator device structured as described above, an opening and closing operation of a window glass W and an operation of the object pinching detection unit 6 are the same as the operations described in the above-mentioned first embodiment, and description thereof is therefore omitted herein. An operational component different from that in the first embodiment, specifically, the operation of the position detection unit 7, is described below.

Figure 30:
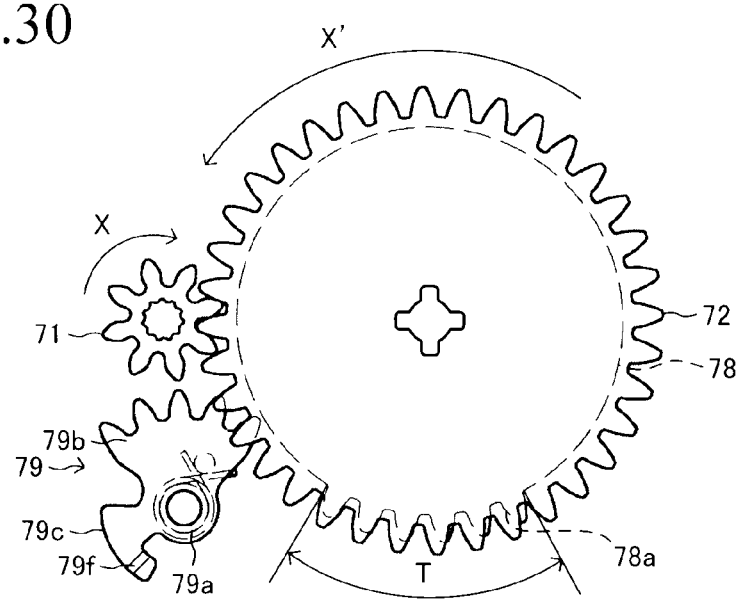
FIG. 30 is a front view illustrating an arrangement relationship between a lever drive gear and the operation lever in a case where the open/close position of the window glass is the fully opened position.

When the output shaft 3 rotates along with the opening and closing operation of the window glass W, the rotation is transmitted to the first gear 71 coupled to the output shaft 3, and the first gear 71 rotates. When the first gear 71 rotates, the second gear 72 meshing with the first gear 71 rotates in a direction opposite to the direction of the first gear 71. Along with the rotation of the second gear 72, the lever drive gear 78 integrally rotates. The rotational position of the tooth portion 78*a* formed in the lever drive gear 78 relative to the operation lever 79 is determined in advance in association with the open/close position of the window glass W, which changes along with the rotation of the output shaft 3. FIG. 30 is a front view illustrating an arrangement relationship between the lever drive gear 78 and the operation lever 79 in a case where the open/close position of the window glass W is the fully opened position. The lever drive gear 78 is arranged relative to the operation lever 79 so that, when the open/close position of the window glass W is the fully opened position, the rotational position of the tooth portion 78*a* corresponds to a rotational position indicated by an area T of FIG. 30. At this rotational position, the tooth portion 78*a* of the lever drive gear 78 does not mesh with the gear portion 79*b* of the operation lever 79.

When the window glass is closed, the first gear 71 rotates in the X direction of FIG. 30 from the arrangement state illustrated in FIG. 30. When the first gear 71 rotates in the X direction, the second gear 72 rotates in the X' direction opposite to the X direction. In association with the X'-directional rotation of the second gear 72, the lever drive gear 78 also rotates in the X' direction. Through the rotation of the lever drive gear 78, the tooth portion 78*a* also rotates in the X' direction. When the open/close position of the window glass W has reached the insensitive area start position (position indicated by the line R of FIG. 13), the tooth portion 78*a* reaches a rotational position indicated by an area T of FIG. 32. At this rotational position, the tooth portion 78*a* starts to mesh with the gear portion 79*b* of the operation lever 79.

Figure 31:
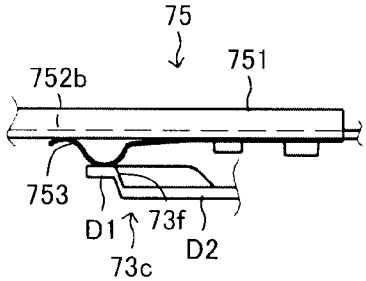
FIG. 31 is a side view illustrating a contact state between the operation lever and the insensitive area detection switch at the time when the operation lever according to the second embodiment is not rotated.
Figure 32:
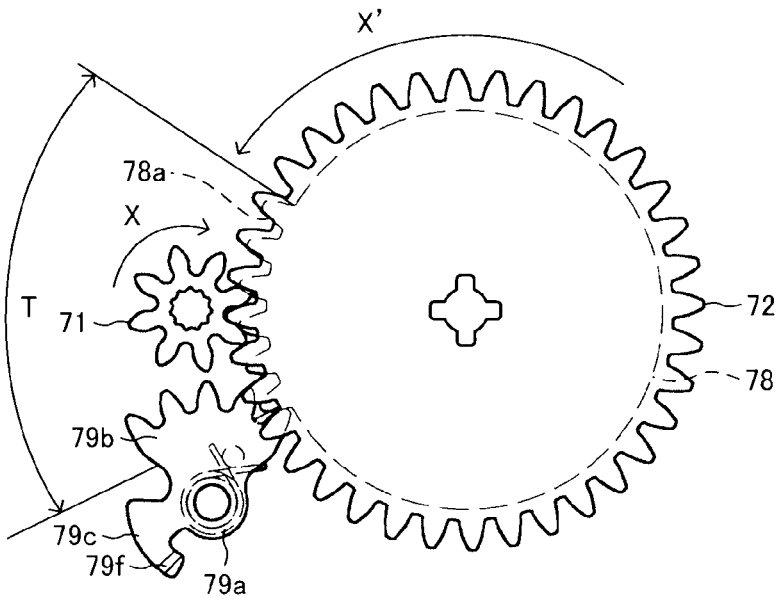
FIG. 32 is a front view illustrating an arrangement relationship between the lever drive gear and the operation lever in a case where the open/close position of the window glass is the insensitive area start position.

When the window glass W is closed in a range from the fully opened position to the insensitive area start position, the tooth portion 78*a* of the lever drive gear 78 rotates from the rotational position indicated by the area T of FIG. 30 to the rotational position indicated by the area T of FIG. 32. In a period in which the tooth portion 78*a* is rotating in such a rotational area, the lever drive gear 78 and the operation lever 79 do not mesh with each other. Therefore, the rotational drive force of the output shaft 3 is not transmitted to the operation lever 79, and hence the operation lever 79 is not rotated. FIG. 31 is a side view illustrating a contact state between the operation lever 79 and the insensitive area detection switch 75 in a case where the tooth portion 78*a* of the lever drive gear 78 rotates in the above-mentioned rotational area. As illustrated in FIG. 31, the movable piece 753 of the insensitive area detection switch 75 abuts against the part D1 that is higher in position in the height direction than the part D2 across the step 79*f* of the lever portion 79*c* of the operation lever 79, and is held in contact with the second conductive portion 752*b* while receiving a pressing force from the part D1. Thus, when the open/close position of the window glass W is situated within an area ranging from the fully opened position to the insensitive area start position, that is, when the open/close position of the window glass W is situated out of the insensitive area, the switching state of the insensitive area detection switch 75 is the ON state.

Figure 33:
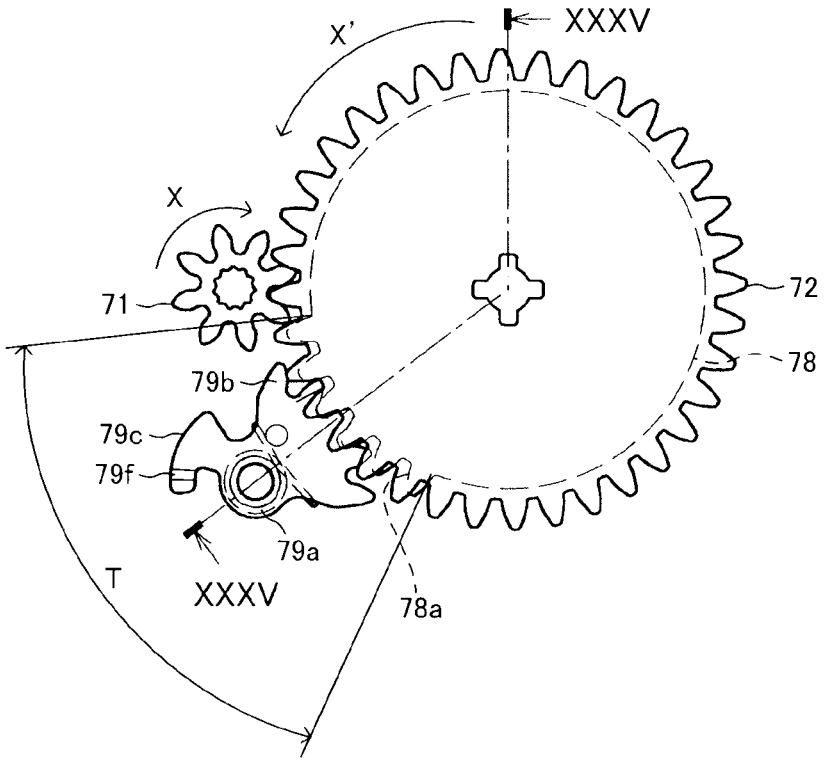
FIG. 33 is a front view illustrating an arrangement relationship between the lever drive gear and the operation lever in a case where the operation lever according to the second embodiment is rotated.
Figure 34:
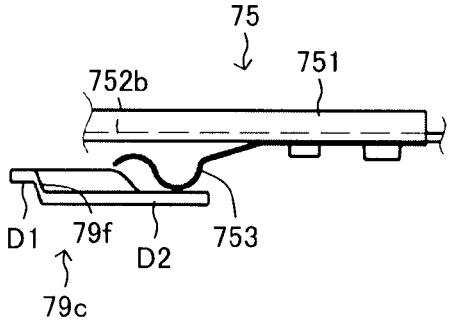
FIG. 34 is a side view illustrating a contact state between the operation lever and the insensitive area detection switch in a case where the operation lever according to the second embodiment is rotated.
Figure 35:
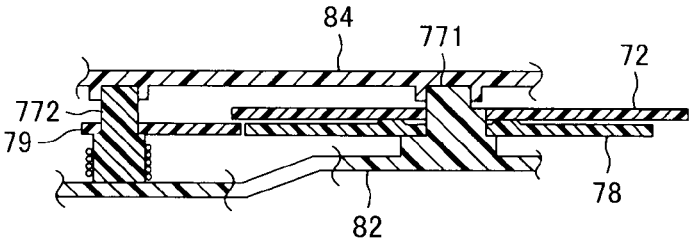
FIG. 35 is a sectional view taken along the line XXXV-XXXV of FIG. 33.

When the window glass W is further closed beyond the insensitive area start position, the rotational position of the tooth portion 78*a* of the lever drive gear 78 is further shifted in the X' direction from the position illustrated in FIG. 32. Accordingly, the tooth portion 78*a* of the lever drive gear 78 and the gear portion 79*b* of the operation lever 79 mesh with each other, and the lever drive gear 78 and the operation lever 79 engage with each other. Through the engagement, the operation lever 79 rotates in the X direction about the second support pin 772 against the elastic force of the retention spring 74. FIG. 33 is a front view illustrating an arrangement relationship between the lever drive gear 78 and the operation lever 79 in a case where the operation lever 79 rotates. Further, FIG. 34 is a view illustrating an arrangement relationship between the operation lever 79 and the insensitive area detection switch 75 in a case where the operation lever 79 rotates, and FIG. 35 is a sectional view taken along the line XXXV-XXXV of FIG. 33. As illustrated in FIG. 34, when the operation lever 79 is rotated, the movable piece 753 of the insensitive area detection switch 75 abuts against the part D2 that is lower in position in the height direction than the part D1 across the step 79*f* of the operation lever 79, and is spaced apart from the second conductive portion 752*b*. Thus, the switching state of the insensitive area detection switch 75 becomes the OFF state. As described above, the operation lever 79 rotates when the window glass W is further closed beyond the insensitive area start position, that is, when the open/close position of the window glass W is situated within the insensitive area. Thus, when the open/close position of the window glass W is situated within the insensitive area, the switching state of the insensitive area detection switch 75 is the OFF state.

As described above, according to this embodiment, when the open/close position of the window glass W is situated out of the insensitive area, the operation lever 79 does not engage with the lever drive gear 78 (rotational member), and the switching state of the insensitive area detection switch 75 becomes the ON state. Meanwhile, when the open/close position of the window glass W is situated within the insensitive area, the operation lever 79 engages with the lever drive gear 78, and the switching state of the insensitive area detection switch 75 becomes the OFF state. Thus, based on the switching state of the insensitive area detection switch 75, it is detected whether or not the open/close position of the window glass W is situated within the insensitive area.

According to this embodiment, the operation lever 79 is used as a detection member for changing the switching state of the insensitive area detection switch 75. The operation lever 79 is a member provided separately from the rotational member (first gear 71, second gear 72, and lever drive gear 78), and hence an operation stroke thereof can be increased irrespective of the size of the rotational member. The operation stroke can be increased, and hence, even if a certain amount of displacement has occurred in the arrangement of the operation lever 79 and the insensitive area detection switch 75, a detection error of the specific positional area based on the displacement can be reduced. Thus, even if the shape of the operation lever 79, the arrangement relationship between the operation lever 79 and the insensitive area detection switch 75, and the like are not strictly managed, the deterioration in detection accuracy can be suppressed sufficiently.

Further, the gear portion 79*b* of the operation lever 79 includes the tooth portion formed therein. Further, the rotational member to be driven to rotate through the rotation of the output shaft 3 includes the first gear 71 supported by the output shaft 3 so as to be rotatable integrally therewith, the second gear 72 supported by the first support pin 771 so as to be meshable with the first gear 71 and configured to reduce the rotation of the first gear 71, and the lever drive gear 78 (third gear) supported by the first support pin 771 so as to be rotatable integrally with the second gear 72 and including the tooth portion 78*a* formed at the part of the outer periphery thereof, the tooth portion 78*a* being meshable with the tooth portion formed in the gear portion 79*b* of the operation lever 79. The tooth portion 78*a* formed in the lever drive gear 78 is formed at such a rotational position as to avoid meshing with the tooth portion formed in the gear portion 79*b* of the operation lever 79 when the open/close position of the window glass W is situated out of the insensitive area, and mesh with the tooth portion formed in the gear portion 79*b* of the operation lever 79 when the open/close position of the window glass W is situated within the insensitive area. Further, the operation lever 79 is rotated by the rotational drive force of the output shaft 3 transmitted via the lever drive gear 78 when the tooth portion of the operation lever 79 meshes with the tooth portion 78*a* formed in the lever drive gear 78. With this structure, the rotational drive force of the output shaft 3 is reliably transmitted to the operation lever 79 via the lever drive gear 78, the second gear 72, and the first gear 71.

The position detection unit 7 further includes the retention spring 74 for elastically aligning the rotational position of the operation lever 79, and the operation lever 79 is rotated by the rotational drive force of the output shaft 3 against the elastic force that is generated by the retention spring 74 when the operation lever 79 meshes with the lever drive gear 78. Accordingly, the operation lever 79 is rotated more reliably.

The embodiments of the present invention have been described above, but the present invention should not be interpreted as being limited to the above-mentioned embodiments. For example, in the above-mentioned embodiments, the arm-type window regulator device has been described as an example, but a cable-type window regulator device or other such window regulator device may be employed alternatively. Note that, in a case where the window regulator device is not the arm-type window regulator device, the moment acting on the output shaft does not change depending on the rotational position of the lift arm. Thus, the erroneous detection of the pinching due to the change in moment does not occur, and hence the cam 72*a* on the second gear 72 and the reverse operation area detection switch 76, which are provided in order to prevent an erroneous operation due to the erroneous detection, may be omitted. Further, in the above-mentioned embodiments, the window regulator device for opening and closing the window glass provided to the side window of the vehicle has been described as an example, but the window regulator device according to the present invention is also applicable as a device for automatically opening and closing a window glass provided to a roof window of the vehicle or other such window glass. The present invention may be modified without departing from the scope of the present invention.

The invention claimed is:

1. A window regulator device, comprising:

a power source; an output shaft connected to the power source and rotatable by a force that is generated by the power source;

a drive force transmission mechanism for transmitting a rotational drive force of the output shaft to a window glass of a vehicle so as to open and close the window glass by the rotational drive force of the output shaft; and a position detection unit that detects whether or not an a position of the window glass is situated within a specific positional area, wherein the position detection unit comprises:

a rotational member rotatable by the rotational drive force of the output shaft;

an operation lever which does not engage with the rotational member when the window glass is situated out of the specific positional area and engages with the rotational member when the window glass is situated within the specific positional area, the operation lever being rotated by the rotational drive force of the output shaft transmitted via the rotational member when the operation lever engages with the rotational member; and a specific positional area detection switch for performing a switching operation based on a position of the operation lever.

2. A window regulator device according to claim 1, wherein the rotational member comprises:

a second gear, wherein the second gear meshes with a first gear supported by the output shaft so as to be rotatable integrally therewith, the second gear comprising an engagement member engageable with the operation lever, wherein the engagement member does not engage with the operation lever when the window glass is situated out of the specific positional area and engages with the operation lever when the window glass is situated within the specific positional area, and wherein the operation lever is rotated by the rotational drive force of the output shaft transmitted via the second gear when the operation lever engages with the engagement member.

3. A window regulator device according to claim 2, wherein the operation lever is rotatably supported by the output shaft and is coupled to the second gear via a coupling pin.

4. A window regulator device according to claim 3, wherein the position detection unit further comprises:

a biasing member for biasing the operation lever to rotate toward an alignment member, the alignment member determining an end position of the operation lever.

5. A window regulator device according to claim 1, wherein the operation lever comprises a tooth portion, wherein the rotational member comprises:

a second gear supported by a support pin, wherein said second gear meshes with a first gear supported by the output shaft so as to be rotatable integrally therewith; and a third gear supported by the support pin, rotatable integrally with the second gear and comprising a tooth portion formed on a part of an outer periphery thereof, the tooth portion of the third gear being meshable with the tooth portion of the operation lever, wherein the tooth portion of the third gear does not mesh with the tooth portion of the operation lever when the window glass is situated out of the specific positional area and meshes with the tooth portion of the operation lever when the window glass is situated within the specific positional area, and wherein the operation lever is rotated by the rotational drive force of the output shaft transmitted via the second and third gears when the tooth portion of the operation lever meshes with the tooth portion of the third gear.

6. A window regulator device according to claim 5, wherein the position detection unit further comprises an elastic member which urges the operation lever to rotate in a first direction, and the operation lever is rotated in a second direction opposite the first direction by the rotational drive force of the output shaft against an elastic force generated by the elastic member when the operation lever meshes with the third gear.

* * * * *